US011986035B2

(12) United States Patent
Ambrosy

(10) Patent No.: US 11,986,035 B2
(45) Date of Patent: May 21, 2024

(54) SWIMWEAR GARMENT WITH SELECTIVE BOTTOM CONTROL

(71) Applicant: TARGET BRANDS, INC., Minneapolis, MN (US)

(72) Inventor: Donette Marie Ambrosy, Minneapolis, MN (US)

(73) Assignee: TARGET BRANDS, INC., Minneapolis, MN (US)

( * ) Notice: Subject to any disclaimer, the term of this patent is extended or adjusted under 35 U.S.C. 154(b) by 0 days.

(21) Appl. No.: 17/733,801

(22) Filed: Apr. 29, 2022

(65) Prior Publication Data

US 2023/0346052 A1 Nov. 2, 2023

(51) Int. Cl.
*A41D 7/00* (2006.01)
*A41D 31/18* (2019.01)

(52) U.S. Cl.
CPC ..... *A41D 7/005* (2013.01); *A41D 31/185* (2019.02); *A41D 2400/38* (2013.01)

(58) Field of Classification Search
CPC ..... A41D 7/005; A41D 7/00; A41D 2400/38; A41D 31/185; A41B 2400/38; A41C 1/003
See application file for complete search history.

(56) References Cited

U.S. PATENT DOCUMENTS 4,654,894 A 4/1987 Kudo
4,916,755 A 4/1990 Feigenbaum et al.
4,956,878 A * 9/1990 Boynton ..... A41D 7/00 450/11
5,359,732 A 11/1994 Waldman et al.
5,787,732 A 8/1998 Perron et al.
5,888,118 A 3/1999 Kishi
5,978,963 A * 11/1999 Moskowitz ..... A41C 1/08 450/95
6,035,448 A * 3/2000 Thomson ..... A41D 1/06 2/237

(Continued)

OTHER PUBLICATIONS

"Island Escape High-Waist Tummy Control Top Bikini Bottoms, Created for Macy's" printed from https://www.macys.com/shop/product/island-escape-high-waist-tu... Qkq5S6IWFYJJL79Gnjd1iwtMDN2z_YJCq1esD7KEJMciAEMgaAoZUEALw_wcB; available on line at least as early as Feb. 2, 2021; 4 pages.

(Continued)

*Primary Examiner* — Heather Mangine
(74) *Attorney, Agent, or Firm* — Griffiths & Seaton PLLC; Joann M. Seaton

(57) ABSTRACT

A swimwear garment configured to be worn by a wearer having buttocks, the swimwear garment comprising an outer rear layer and a rear compression layer. The outer rear layer defines rear portions of two leg openings and extends upwardly toward a waist of the swimwear garment in a manner configured to at least partially cover the buttocks of the wearer. The rear compression layer is coupled to the outer rear layer along an inside surface of the outer rear layer and defines a bottom periphery and opposing side edges. The rear compression layer extends upwardly from the bottom periphery to at least to the waist of the swimwear garment. Each of the opposing side edges of the rear compression layer are sewn to the outer rear layer. The bottom periphery of compression fabric layer is entirely positioned above the at least rear portions of the leg openings.

19 Claims, 31 Drawing Sheets

(56) References Cited

U.S. PATENT DOCUMENTS

| | | | | |
|---|---|---|---|---|
| 6,626,883 | B2 | 9/2003 | Wada et al. | |
| 6,728,973 | B1 | 5/2004 | Webley et al. | |
| 6,766,533 | B1 | 7/2004 | Meier et al. | |
| 6,807,685 | B1 | 10/2004 | Hasegawa et al. | |
| 7,087,032 | B1 | 8/2006 | Ikeda | |
| 7,260,961 | B1 | 8/2007 | Kennedy | |
| 7,509,822 | B2 | 3/2009 | Ishida et al. | |
| 7,526,929 | B2 | 5/2009 | Takamoto et al. | |
| 7,559,093 | B2 | 7/2009 | Sudo et al. | |
| 7,814,569 | B2 | 10/2010 | Lorenzo | |
| D634,510 | S | 3/2011 | Waldman | |
| D728,896 | S | 5/2015 | Waldman | |
| 9,119,424 | B2 | 9/2015 | Kakuno et al. | |
| 9,198,806 | B2 | 12/2015 | Vignali et al. | |
| 9,468,235 | B2 | 10/2016 | Hoeven et al. | |
| D785,905 | S | 5/2017 | Savage et al. | |
| 9,717,289 | B1 | 8/2017 | Fooden et al. | |
| 9,968,139 | B2 * | 5/2018 | Callahan | A41D 1/14 |
| D821,059 | S | 6/2018 | Savage et al. | |
| 11,096,430 | B2 * | 8/2021 | Otashevich | A41D 1/06 |
| 11,510,442 | B2 * | 11/2022 | Strobel | A41D 27/02 |
| 2006/0166600 | A1 | 7/2006 | Ravoiu et al. | |
| 2006/0253960 | A1 * | 11/2006 | Horn | A41D 1/06 2/227 |
| 2008/0083055 | A1 | 4/2008 | Onda | |
| 2008/0256675 | A1 | 10/2008 | Lorenzo | |
| 2008/0256676 | A1 | 10/2008 | Lorenzo | |
| 2009/0017722 | A1 | 1/2009 | Ravoiu et al. | |
| 2009/0038047 | A1 | 2/2009 | Lorenzo | |
| 2010/0205713 | A1 * | 8/2010 | Takamoto | A41D 31/18 2/243.1 |
| 2011/0131705 | A1 * | 6/2011 | Waldman | A41F 9/00 2/221 |
| 2011/0225696 | A1 | 9/2011 | Lorenzo | |
| 2013/0291287 | A1 * | 11/2013 | Shoemaker | A41D 7/00 2/403 |
| 2014/0215690 | A1 * | 8/2014 | Caulfield | A41F 17/00 2/227 |
| 2014/0250561 | A1 | 9/2014 | DiLorenzo | |
| 2016/0113334 | A1 * | 4/2016 | Roup | A41D 1/067 450/156 |
| 2018/0132546 | A1 * | 5/2018 | Righetto | A41D 1/14 |
| 2019/0246717 | A1 | 8/2019 | Fischer | |
| 2019/0320746 | A1 * | 10/2019 | Otashevich | A41D 31/04 |
| 2020/0260808 | A1 | 8/2020 | Waldman et al. | |
| 2020/0383385 | A1 * | 12/2020 | Deguchi | A41B 9/001 |
| 2021/0153573 | A1 | 5/2021 | Shams | |
| 2023/0346052 | A1 * | 11/2023 | Ambrosy | A41D 7/005 |

OTHER PUBLICATIONS

"Magicsuit Women's Shirred Jersey Swim Bottom 475659W," printed from https://www.magicsuitswim.com/womens-plus-size-shirred-jersey-bottom.html, available online at least as early as Feb. 2, 2021; 6 pages.

"Miraclesuit Swim Network Jena One-Piece Mesh Swimsuit," printed from https://www.saksfifthavenue.com/?orgin=%2Fproduct%2Fmiraclesuit-swim-netwo...xnWT_ekN94HP1cZycR5MawOvyC0XtzHD70RsaAgGNEALw_wcB%26gclsrc%3Daw.ds; available at least as early as Feb. 2, 2021; 3 pages.

"Sculpting Low Back Bodysuit Mid Thigh—Clay," printed from https://skims.com/products/sculpting-low-back-bodysuit-mid-thigh-clay, available at least as early as Jan. 2, 2021; 6 pages.

"Swim Solutions Ultra-High Waist Swim Bottoms," printed from https://www.macys.com/shop/product/swim-solutions-ultra-high-waist-swim-bottoms?ID=758140&CategoryID=8699&swatchColor=Black, available at least least as early as Mar. 21, 2013; 4 pages.

"Women's Slender Tummy Control Chlorine Resistant V-Neck Wrap One," printed from https://www.landsend.com/products/womens-slender-tummy-contr...bAkDuNAZYCKgGVuABW0lbPz08TKH2V5_derPn7G6KgAfF8saAlrEEALw_wcB; available online at least as easy as Dec. 30, 2020; 10 pages.

* cited by examiner

SWIMWEAR GARMENT WITH SELECTIVE BOTTOM CONTROL

BACKGROUND OF THE INVENTION

Swimwear garments have long been staple garments primarily designed for wearing during times spent in and around the water. By nature, modern swimwear garments generally fit tight against the wearer's body and covers less of a wearer's body than typical clothing. These and other general characteristics of swimwear often make wearers wary of the exposure level and how one looks in the swimwear garment since swimwear generally offers little way of hiding the shape, contour, etc. of the wearer's body. As such, wearers generally seek out swimwear garments with cuts and characteristics that best flatter their body and providing an overall appearance on the wearer that is aesthetically appealing to the wearer.

Swimwear garments have continually evolved to meet the wearer's desire to appear their very best in the garments. Typical swimwear garments are made of stretch fabrics, for example, variations of spandex, nylon and spandex, polyester and spandex, or other spandex combinations providing two or more ways stretch to the garment. In more recent years, swimwear garments have also incorporated figure control inner linings used to contain or restrict parts of the body and/or to allow the outer layer to take on different configurations over the inner lining to camouflage various parts of the wearer's body.

SUMMARY

A swimwear garment configured to be worn by a wearer having buttocks, the swimwear garment comprising an outer rear layer and a rear compression layer. The outer rear layer defines at least rear portions of two leg openings and extends upwardly from the two leg openings toward a waist of the swimwear garment in a manner configured to at least partially cover the buttocks of the wearer. The rear compression layer is coupled to the outer rear layer along an inside surface of the outer rear layer and defines a bottom periphery and opposing side edges. The rear compression layer extends upwardly from the bottom periphery to at least to the waist of the swimwear garment. Each of the opposing side edges of the rear compression layer are sewn to corresponding side edges of the outer rear layer. The bottom periphery of compression fabric layer is entirely positioned above the at least rear portions of the leg openings to be positioned above a majority of the buttocks of the wearer during use. Other swimwear garments, assemblies, and associated methods are also described herein.

BRIEF DESCRIPTION OF THE DRAWINGS

Embodiments of the invention will be described with respect to the figures, in which like reference numerals denote like elements, and in which.

DETAILED DESCRIPTION

The following detailed description of the invention provides example embodiments and is not intended to limit the invention or the application and uses of the invention. Furthermore, there is no intention to be bound by any theory presented in the preceding background of the invention or the following detailed description of the invention. Relational terms herein such a first, second, top, bottom, etc. may be used herein solely to distinguish one entity or action from another without necessarily requiring or implying an actual such relationship or order. Directional terminology, such as "front," "back," etc. is used with reference to the orientation in the figure(s) being described. Any directional terminology is used for purposes of illustration and is in no way limiting. In addition, as used herein, the terms "about" or "substantially" apply to all numeric values or descriptive terms, respectively, and generally indicate a range of numbers or characteristics that one of skill in the art would consider equivalent to the recited values or terms, that is, having the same function or results.

Embodiments of the invention are directed a swimwear garment that provides compression of some body areas covered by the swimwear garment while preserving a more natural appearance of other body areas covered by the swimwear garment. For example, swimwear garments of the current innovation may provide compressive control over areas of the wearer's body including the stomach and/or breasts while providing little to no added control to the buttocks of the wearer via use of a variation of control fabrics and/or control fabrics that terminate short of lining an entirety of the swimwear garment.

One embodiment of the present invention includes having a front compression layer that extends along the inside of part of the outside layer of the swimwear garment but terminates before covering all the seat or buttocks area of the swimwear garment. The front compression layer is secured at top and side peripheries thereof, but the bottom periphery is formed as a cut edge that is free from or floats along an inside surface of the outside layer of the swimwear garment. In one embodiment, the cut edge extends along only a very top portion of the bottom of the wearer and terminates in an inverted V-shaped manner to provide for the full shape of the wearer's buttocks to be seen without compression in addition to any provided by the outer layer of the swimsuit garment. In this manner, the front compression layer and other compression layers provide for compressive control of a wearer's stomach and/or breasts, etc. that terminates short of covering any substantial portion of the wearer's buttocks, to provide the selective compressive control desired by many wearers of swimwear garments.

Figure 1:
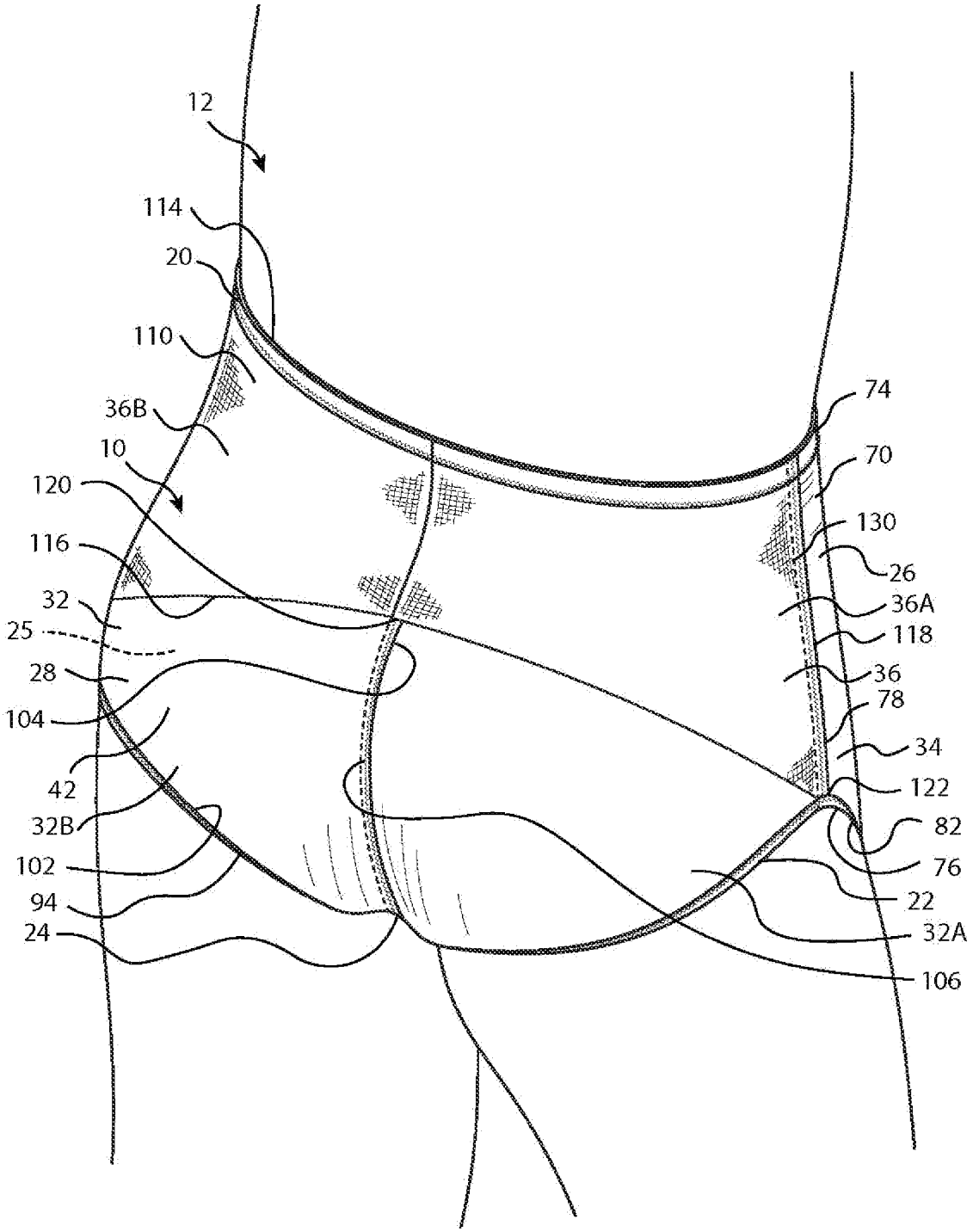
FIG. 1 is a rear, perspective view illustration of a swimwear garment on a wearer's body in an inside-out configuration to show the inside of the swimwear garment, according to an embodiment of the invention.
Figure 2:
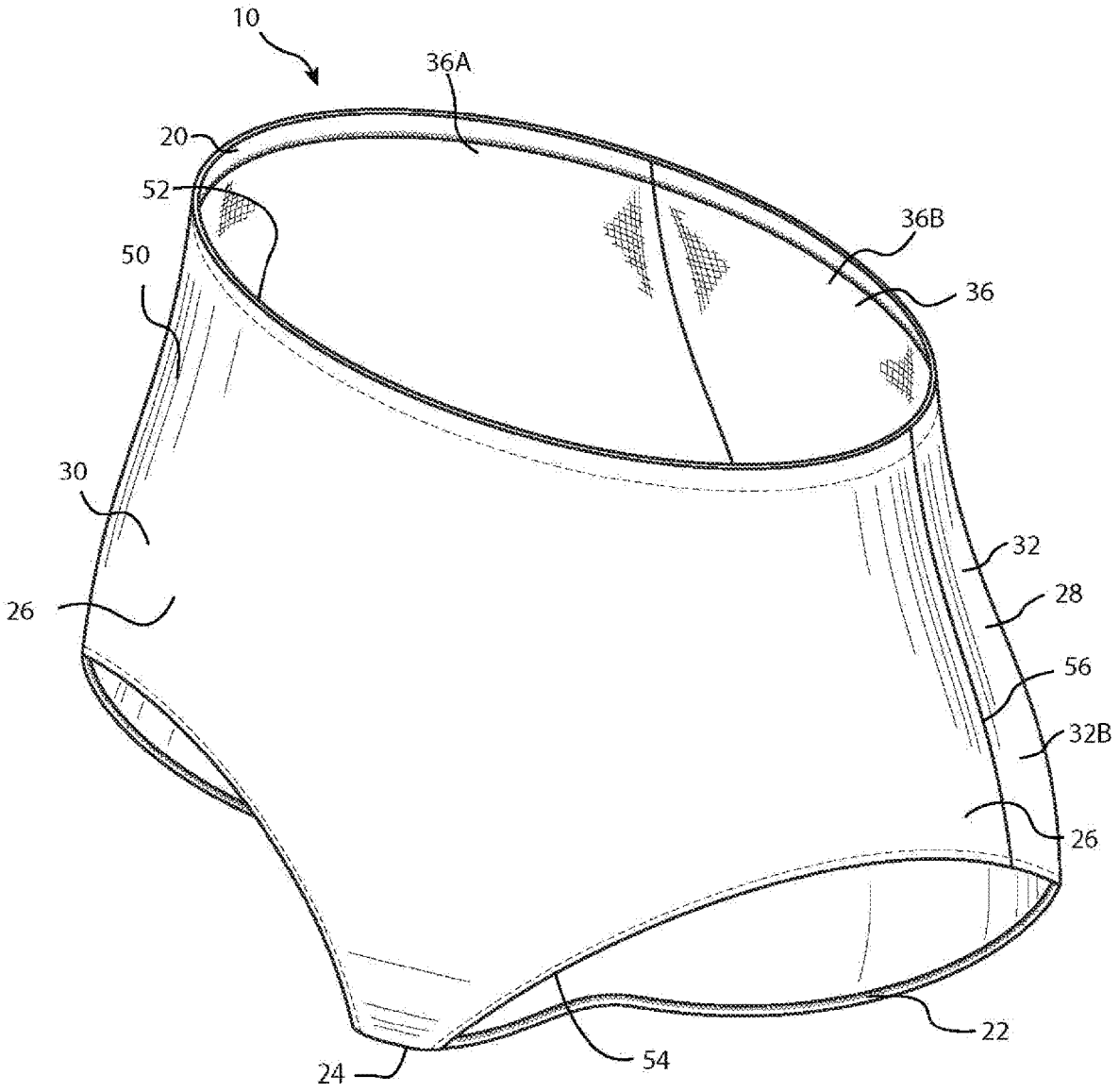
FIG. 2 is a front, perspective view illustration of the swimwear garment of FIG. 1 in a right-side out configuration, according to one embodiment of the present invention.
Figure 3:
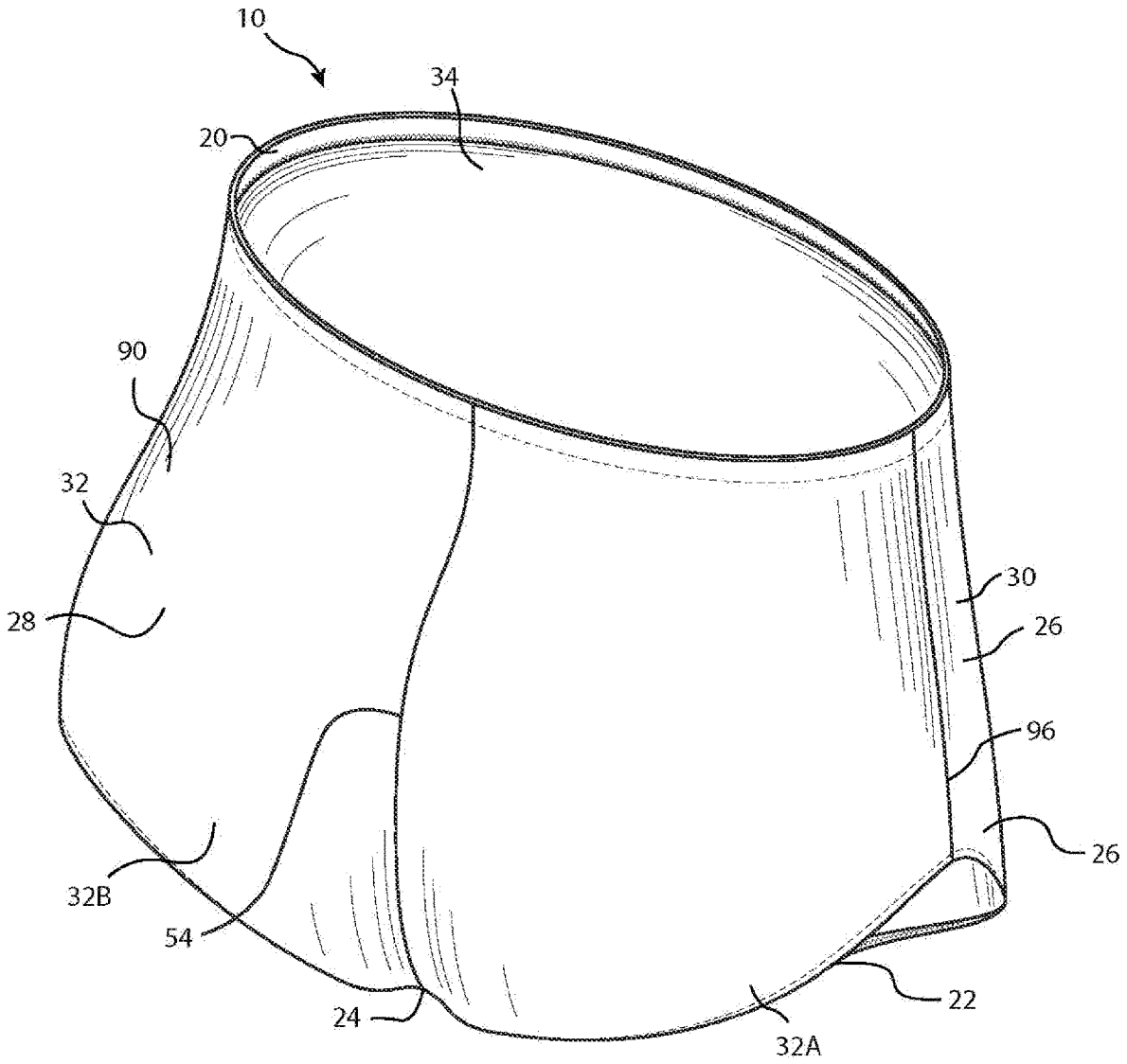
FIG. 3 is a rear, perspective view illustration of the swimwear garment of FIG. 2, according to one embodiment of the present invention.
Figure 4:
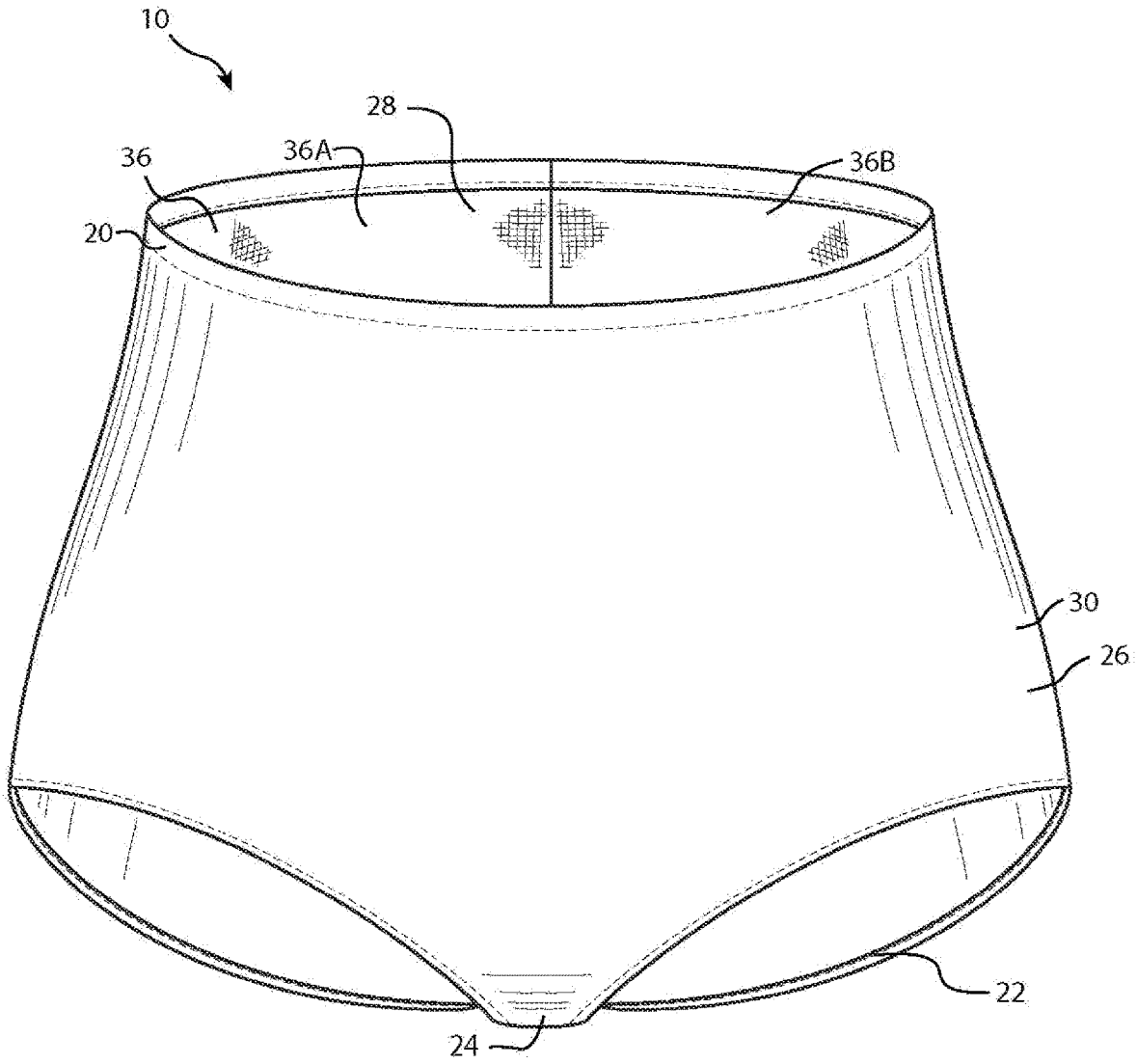
FIG. 4 is a front view illustration of the swimwear garment of FIG. 2, according to one embodiment of the present invention.
Figure 5:
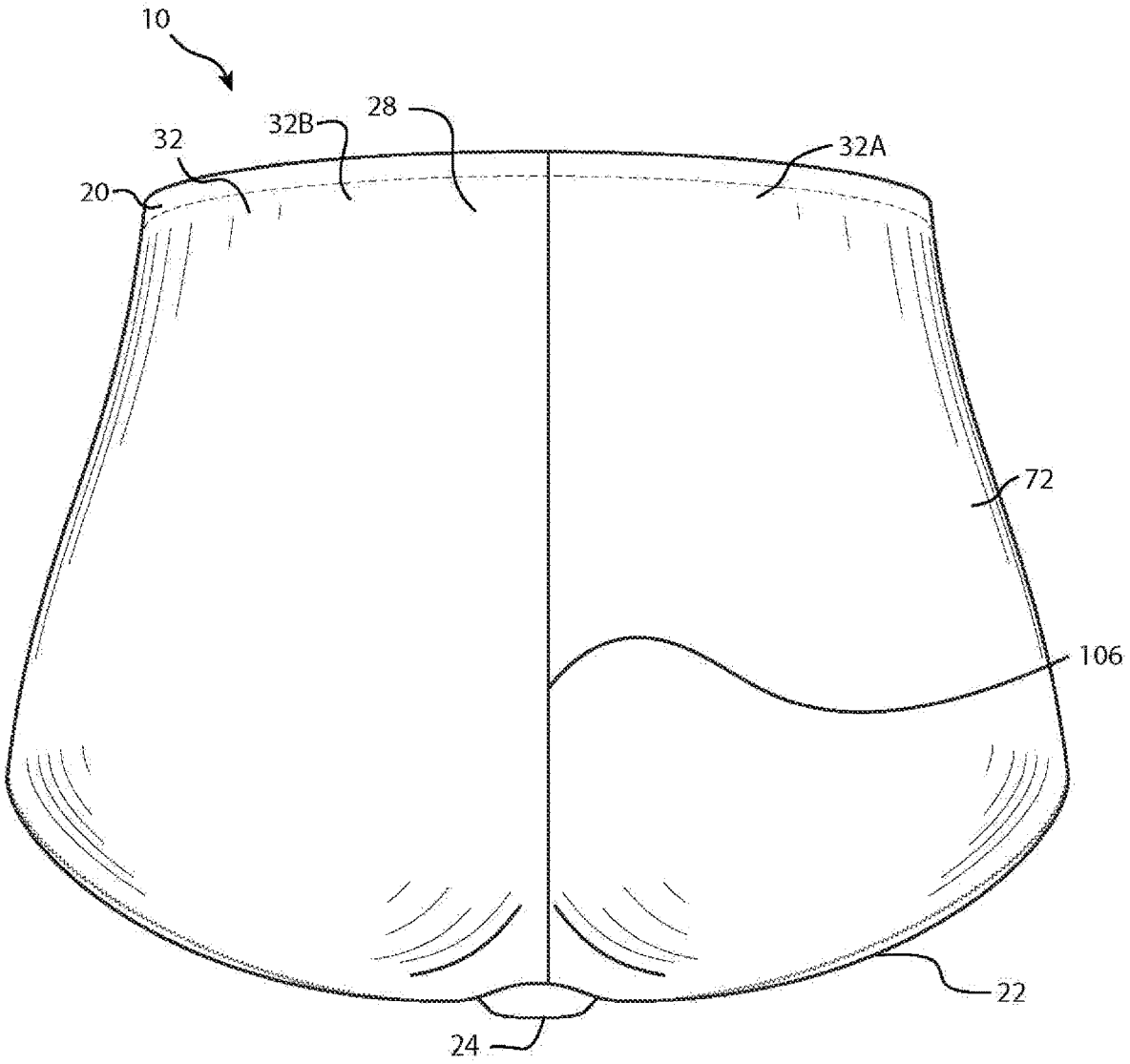
FIG. 5 is a rear view illustration of the swimwear garment of FIG. 2, according to one embodiment of the present invention.
Figure 6:
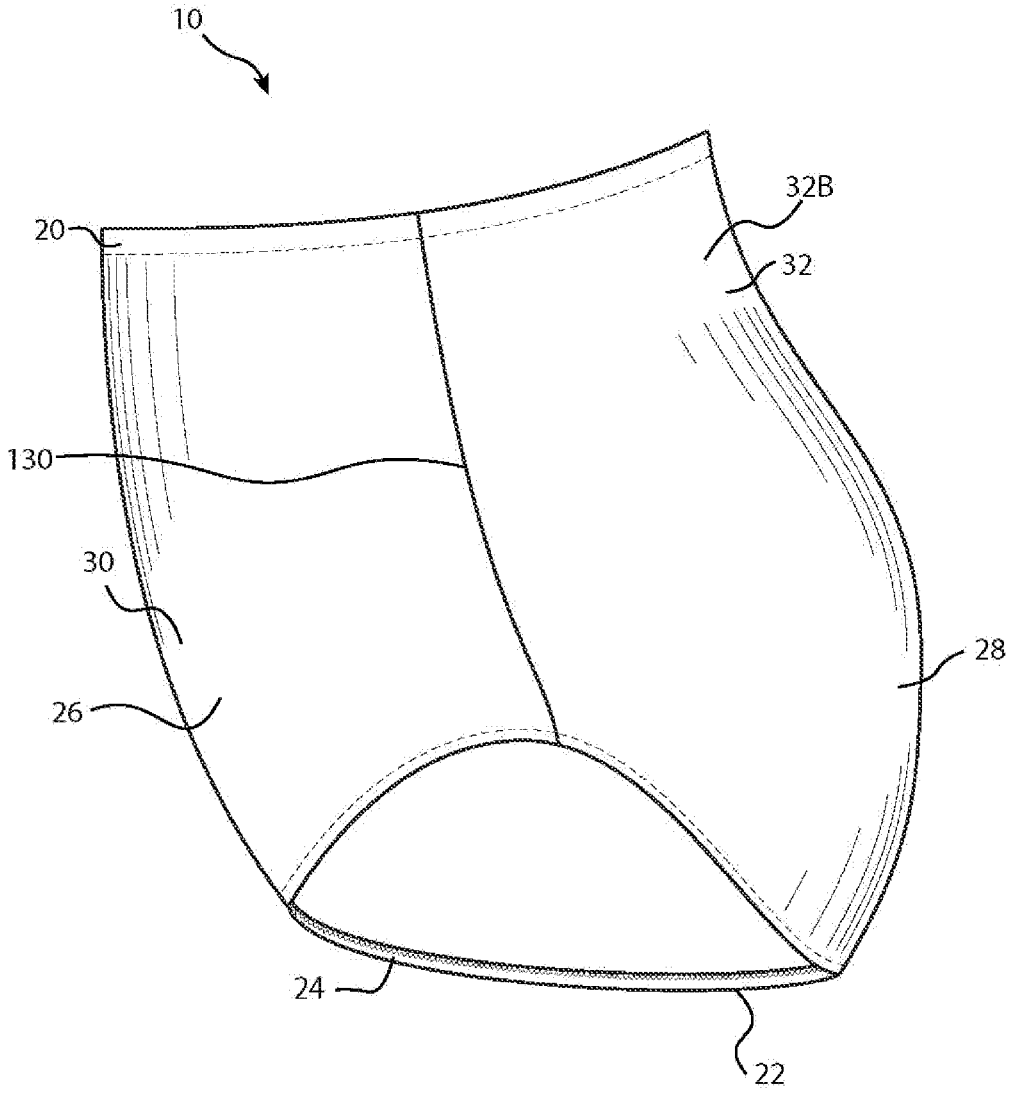
FIG. 6 is a right side view illustration of the swimwear garment of FIG. 2, according to one embodiment of the present invention, where the left side view is a mirror image of the right side view.
Figure 7:
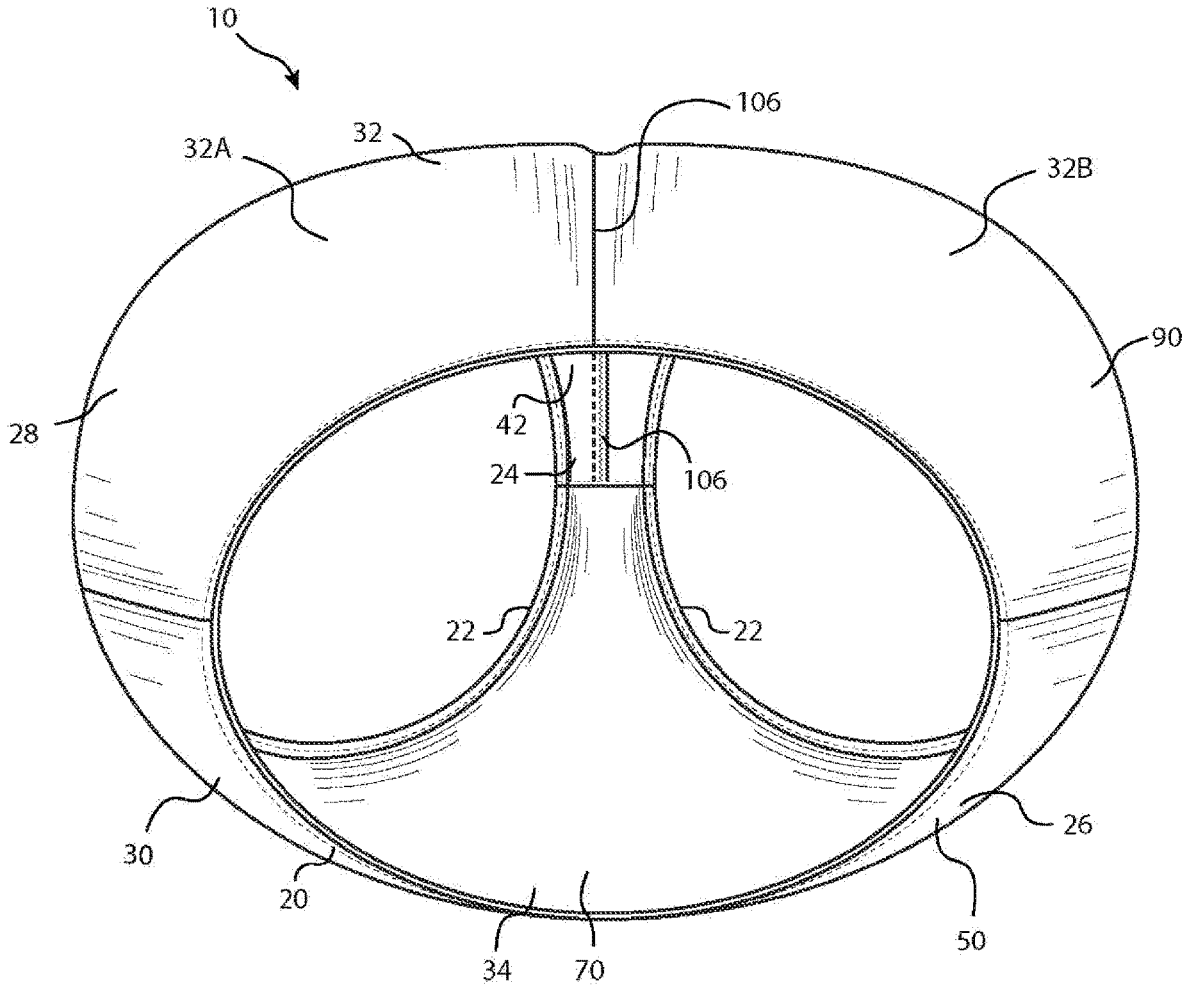
FIG. 7 is a top view illustration of the swimwear garment of FIG. 2, according to one embodiment of the present invention.
Figure 8:
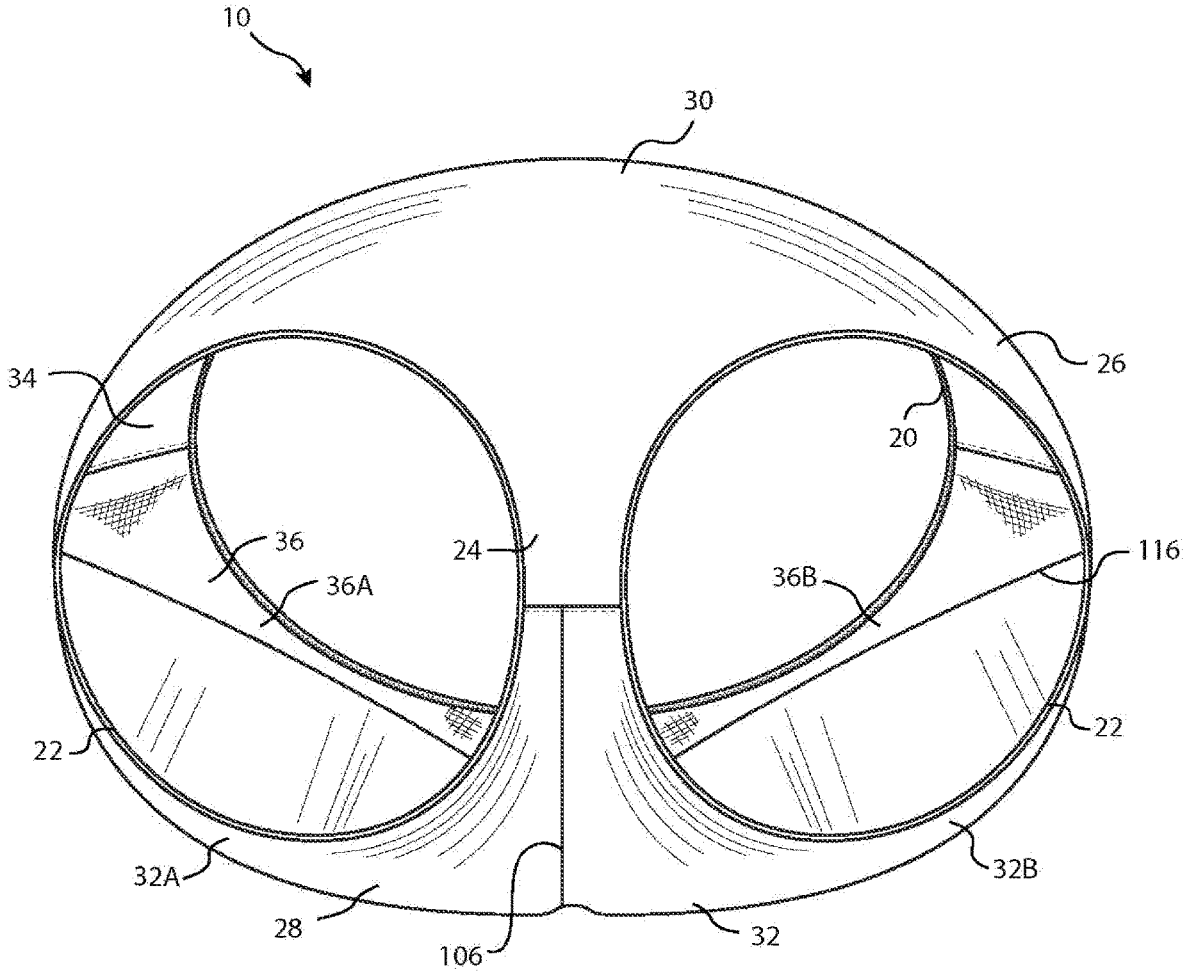
FIG. 8 is a bottom view illustration of the swimwear garment of FIG. 2, according to one embodiment of the present invention.
Figure 9:
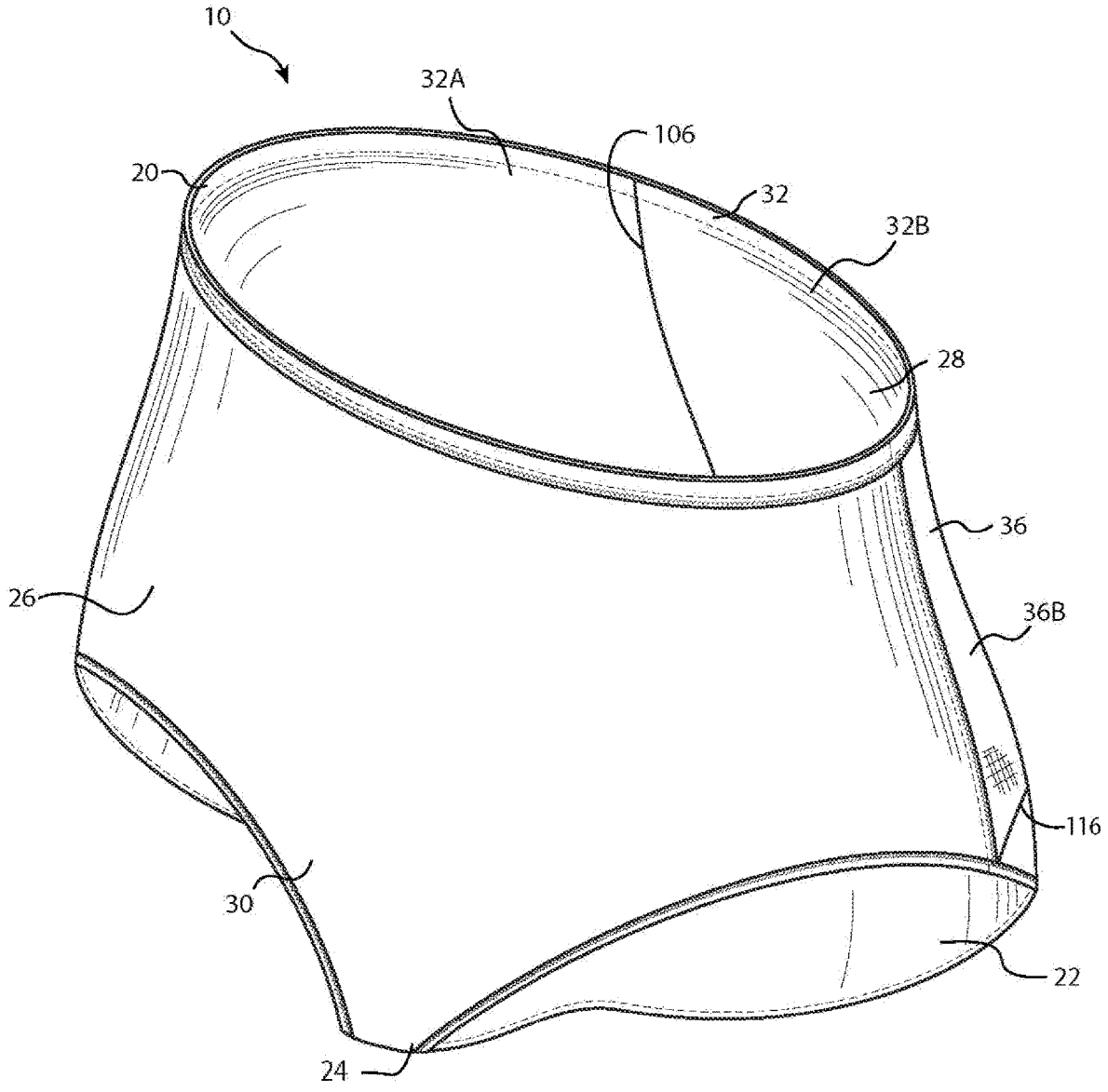
FIG. 9 is a front, perspective view illustration of the swimwear garment of FIG. 2 in an inside-out configuration, according to one embodiment of the present invention.

Turning to the figures, FIG. 1 illustrates an example of a swimwear garment 10 in an inside out configuration on a wearer 12, according to one embodiment of the present invention. Swimwear garment 10 is shown in the in-side out configuration to best illustrate features of swimwear garment 10 and where such features generally align on the body of wearer 12. It should be understood that during actual use, swimwear 10 would be worn in a right-side out configuration, for example as illustrated in FIGS. 2-8. FIGS. 9-15 provide additional views of swimwear garment 10 in the inside-out configuration of FIG. 1. In certain embodiments, such as the embodiment for swimwear garment 10 and the embodiment for swimwear garment 210 shown in FIGS. 17-30, swimwear garment 10 is a swimsuit bottom of a two or more-piece swimsuit, while in other embodiments, swimwear garment 310 is a one-piece swimsuit, as will be further described below with reference to the exemplary embodiment shown in FIG. 31.

Referring to FIGS. 1-15, swimwear garment 10 generally incudes a waist or waistband 20 at a topmost portion thereof, spaced from two lower leg openings 22 with a crotch 24 defined between the two lower leg openings 22. Swimwear garment 10 is configured to at least partially cover the buttocks 25 of wearer 12 as it extends from waistband 20 to the two lower leg openings 22 and crotch 24. Swimwear garment 10 extends between waistband 20 down to the two lower legs openings 22 and crotch 24 in a generally tubular manner to define a stomach or front portion 26, a buttocks or rear portion 28 that each stretch around the body of wearer 12 such that they collectively cover the sides of wearer 12 as well. In one embodiment, each of waistband 20 and lower leg openings 22 are formed with hemmed, rolled, or other finishing to be smooth and comfortable where each interacts with wearer 12, as will be apparent to those of skill in the art upon reading this application.

Figure 16:
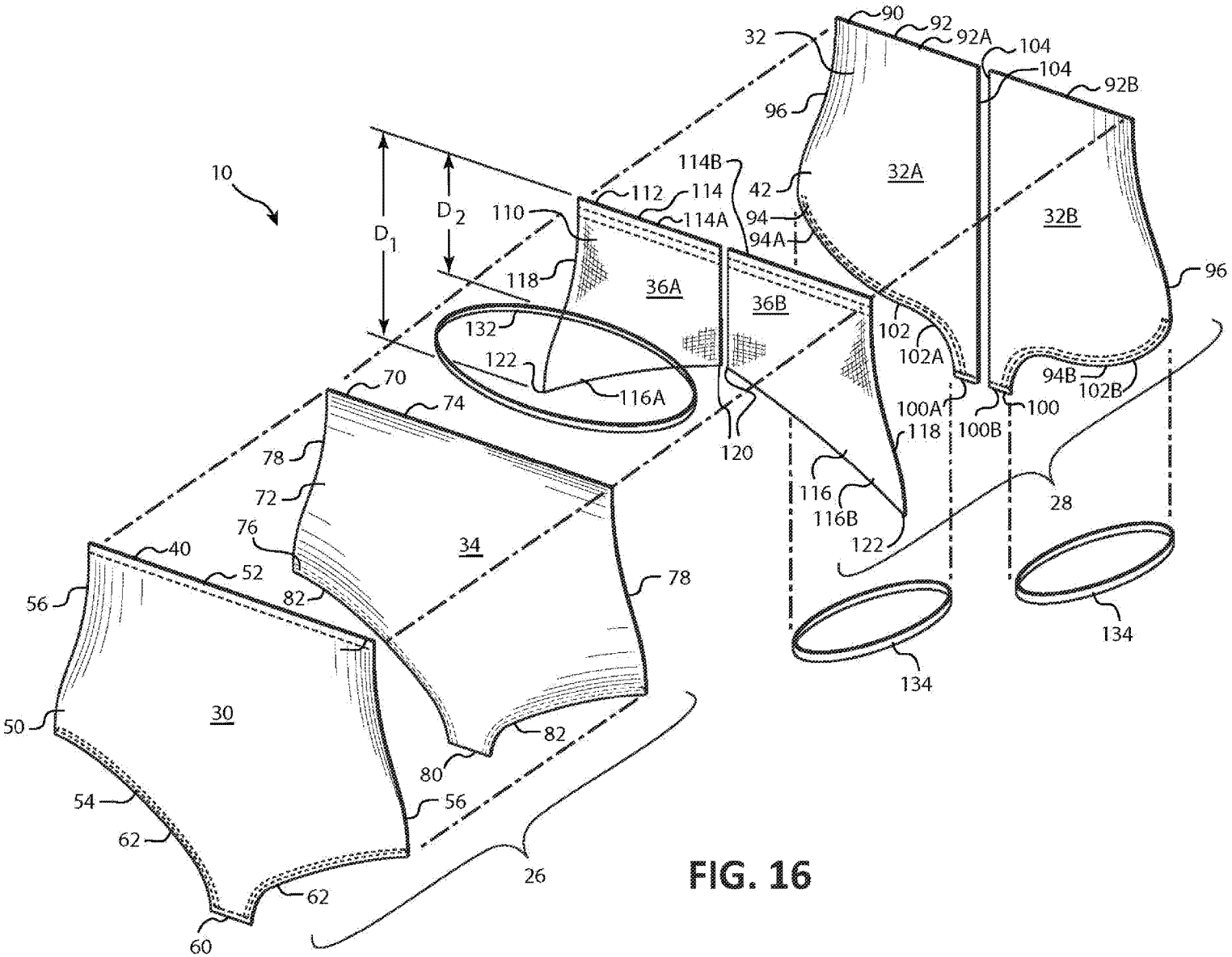
FIG. 16 is an exploded view illustration of the swimwear garment of FIGS. 1-15, according to one embodiment of the present invention.
Figure 17:
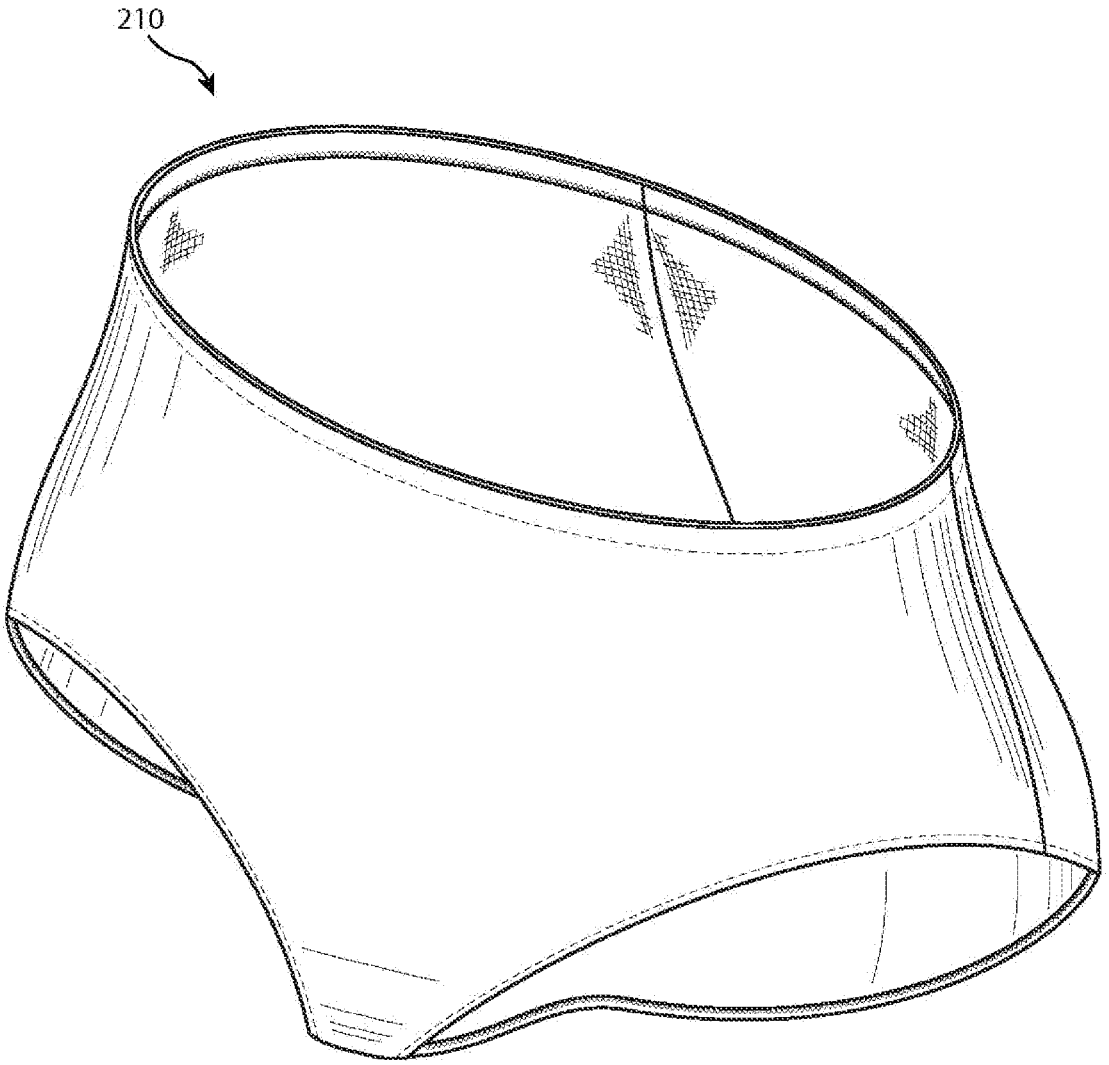
FIG. 17 is a front, perspective view illustration of a swimwear garment in a right-side out configuration, according to one embodiment of the present invention.
Figure 18:
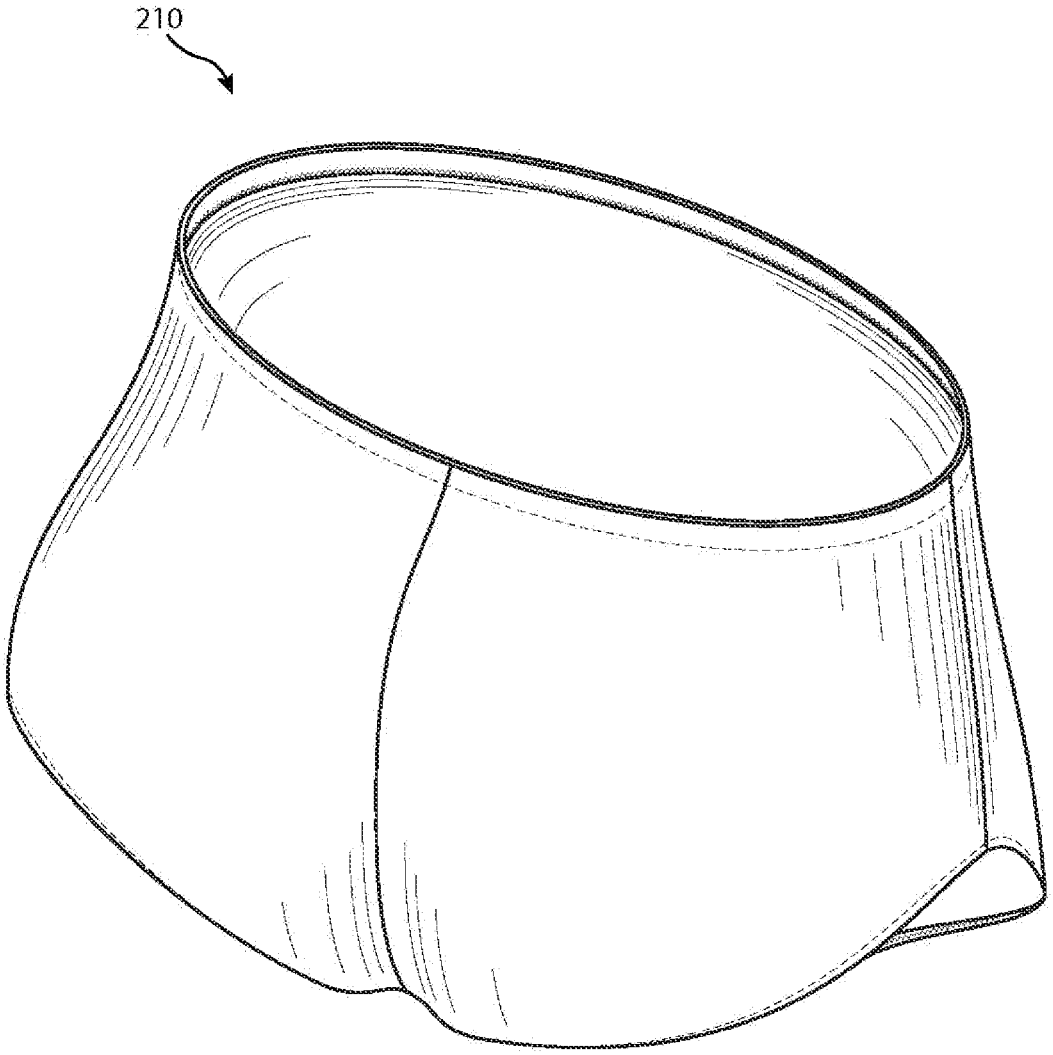
FIG. 18 is a rear, perspective view illustration of the swimwear garment of FIG. 17, according to one embodiment of the present invention.
Figure 19:
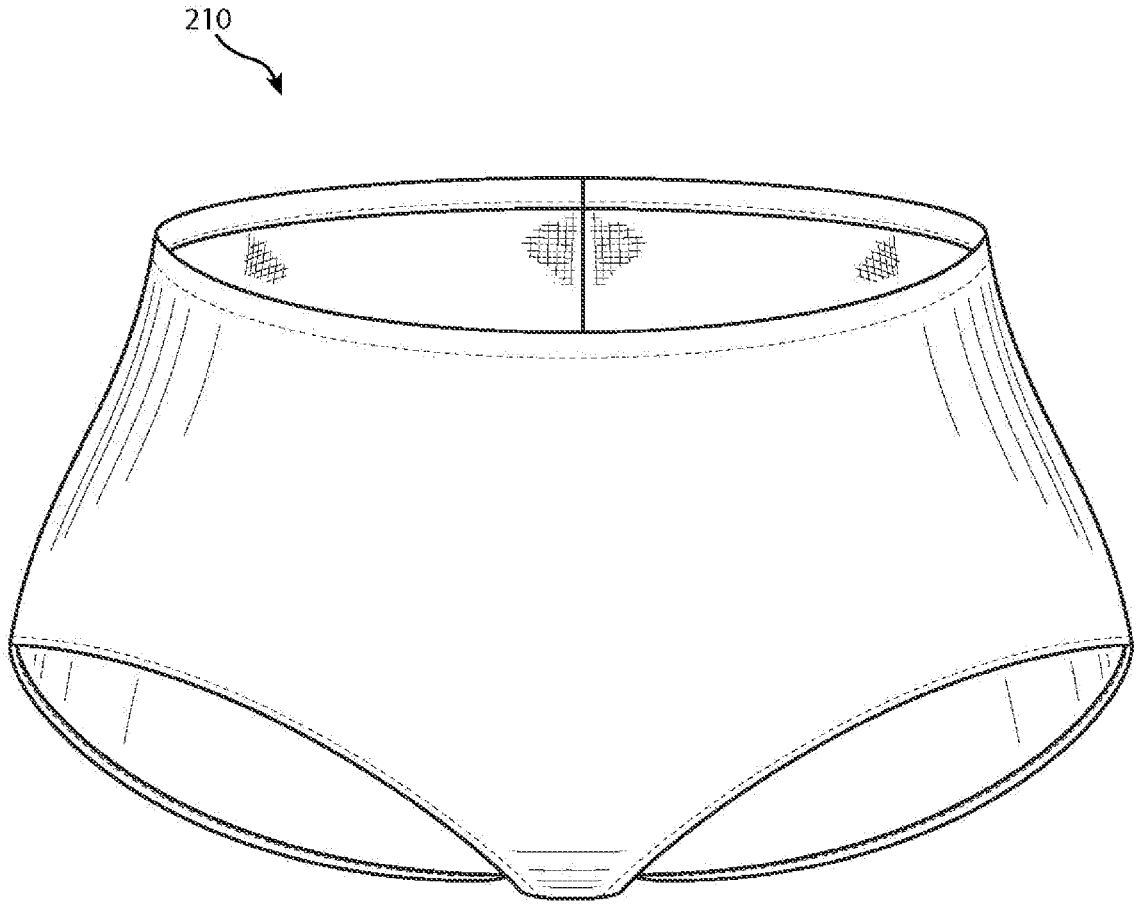
FIG. 19 is a front view illustration of the swimwear garment of FIG. 17, according to one embodiment of the present invention.
Figure 20:
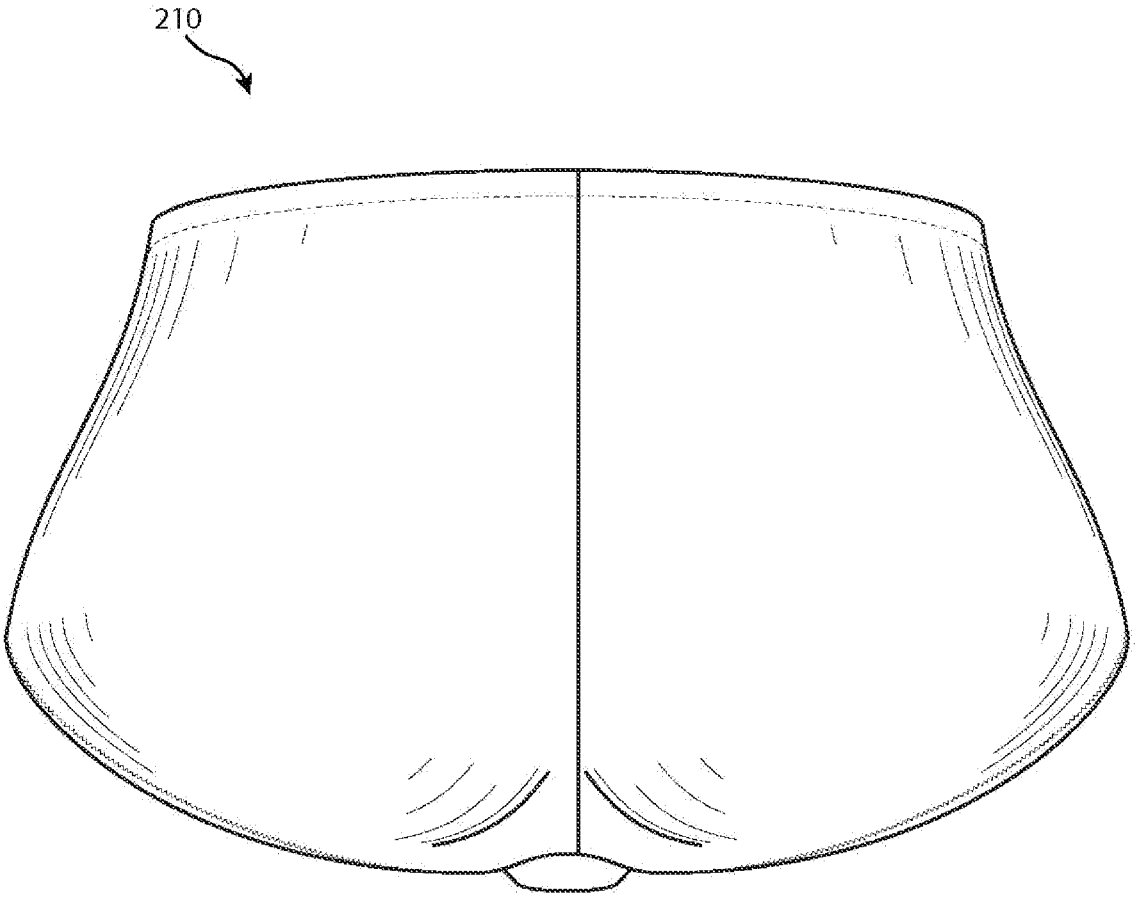
FIG. 20 is a rear view illustration of the swimwear garment of FIG. 17, according to one embodiment of the present invention.
Figure 21:
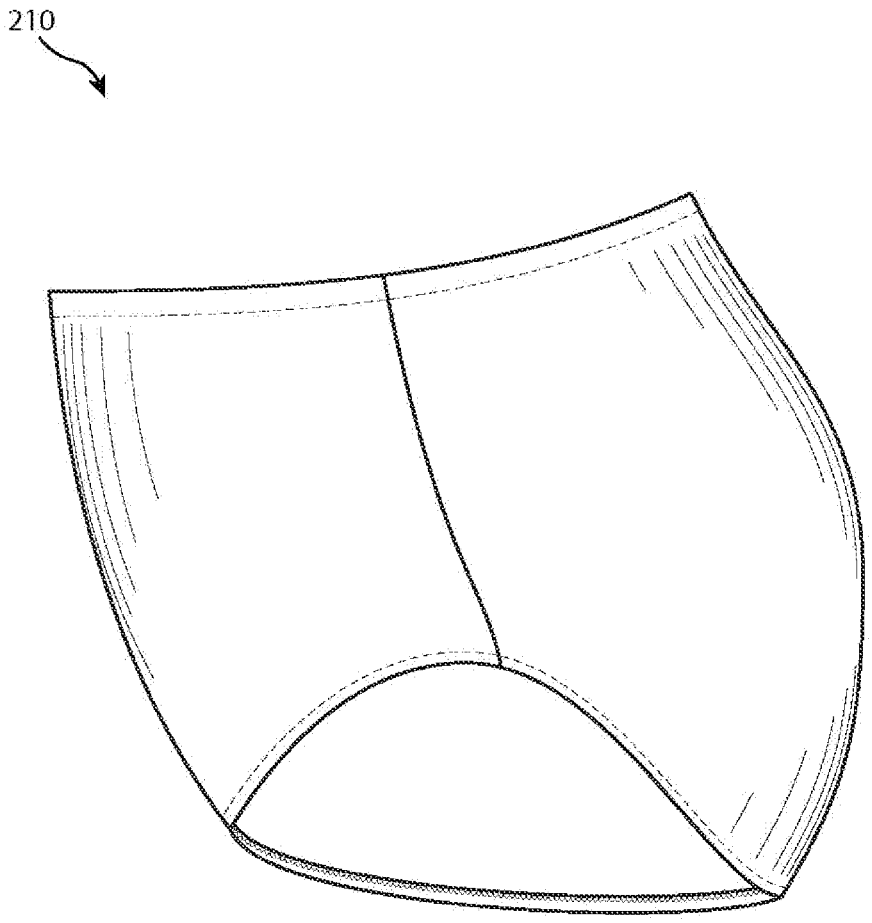
FIG. 21 is a right side view illustration of the swimwear garment of FIG. 17, according to one embodiment of the present invention, where the left side view is a mirror image of the right side view.
Figure 22:
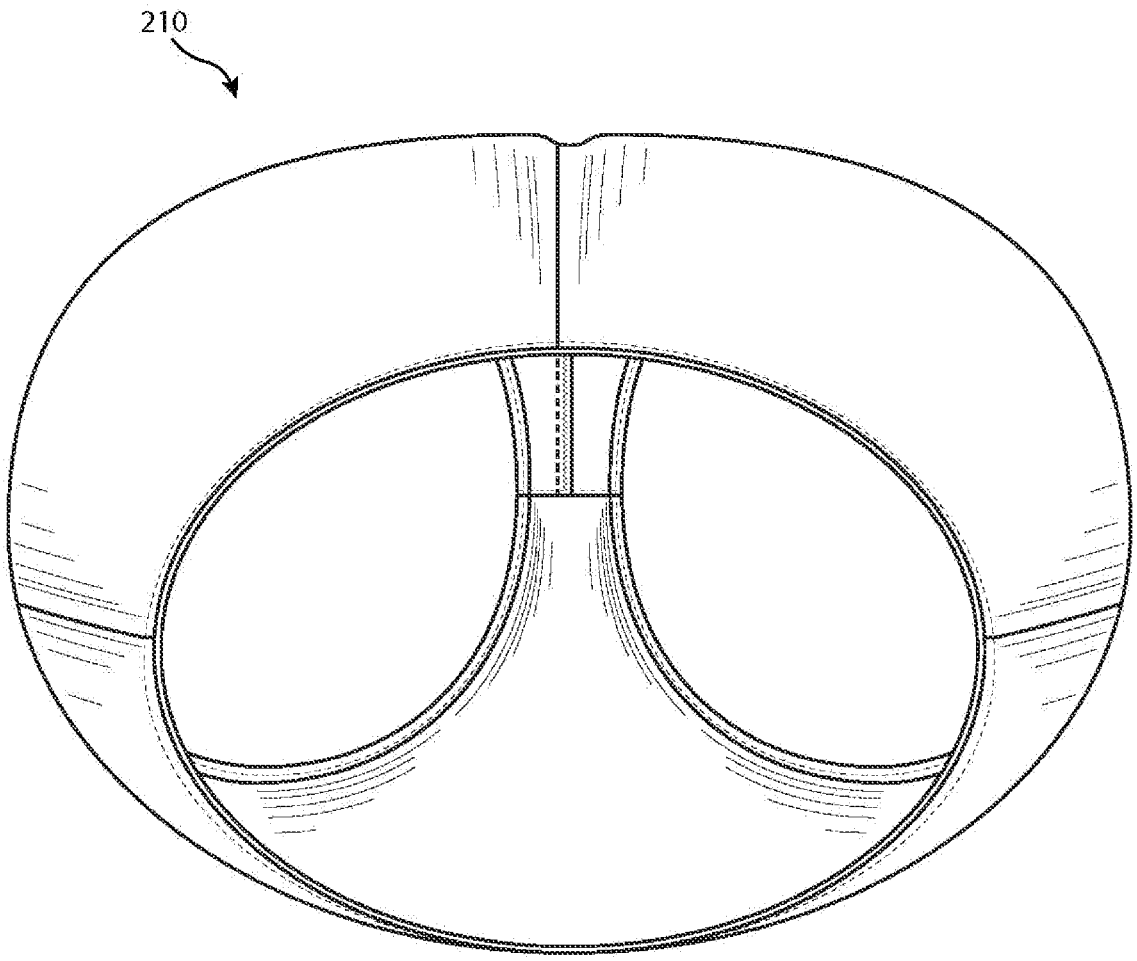
FIG. 22 is a top view illustration of the swimwear garment of FIG. 17, according to one embodiment of the present invention.
Figure 23:
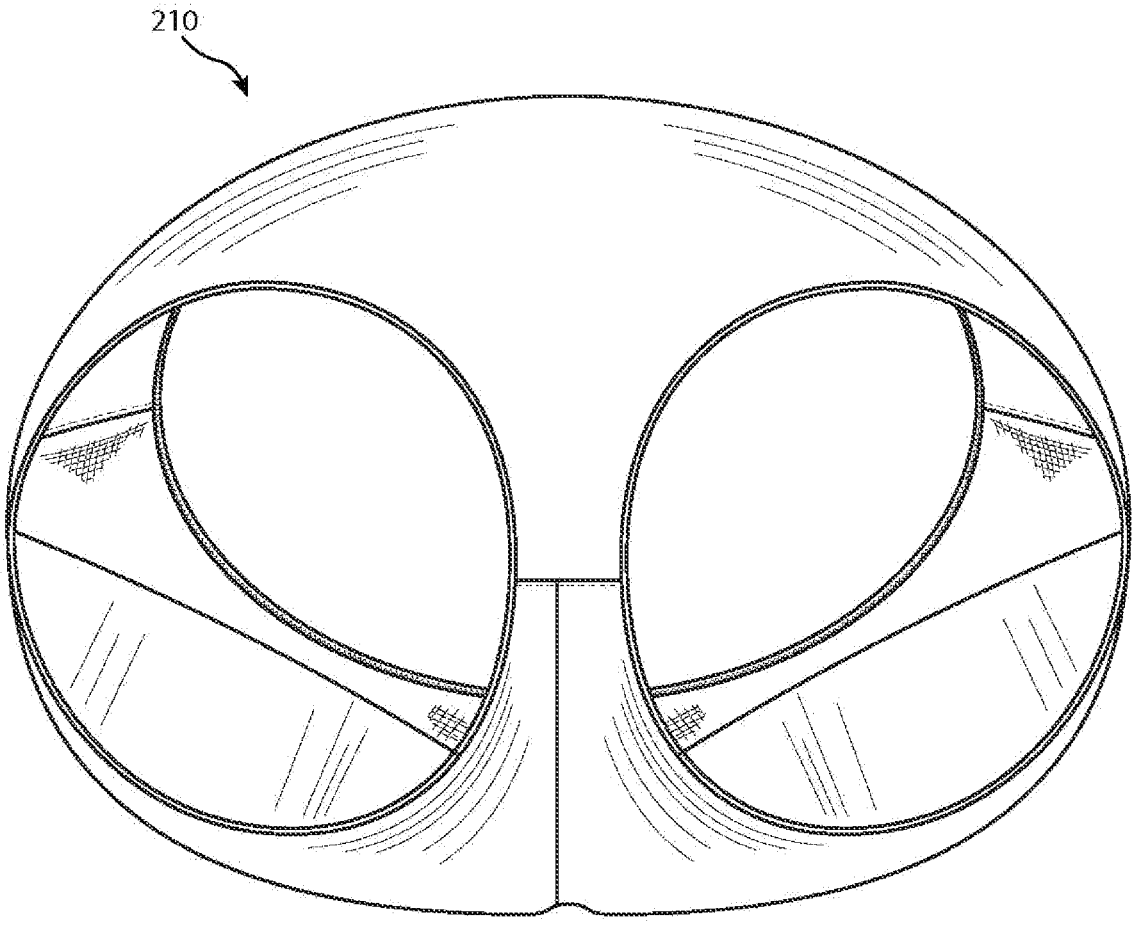
FIG. 23 is a bottom view illustration of the swimwear garment of FIG. 1 in a right-side out configuration, according to one embodiment of the present invention.
Figure 24:
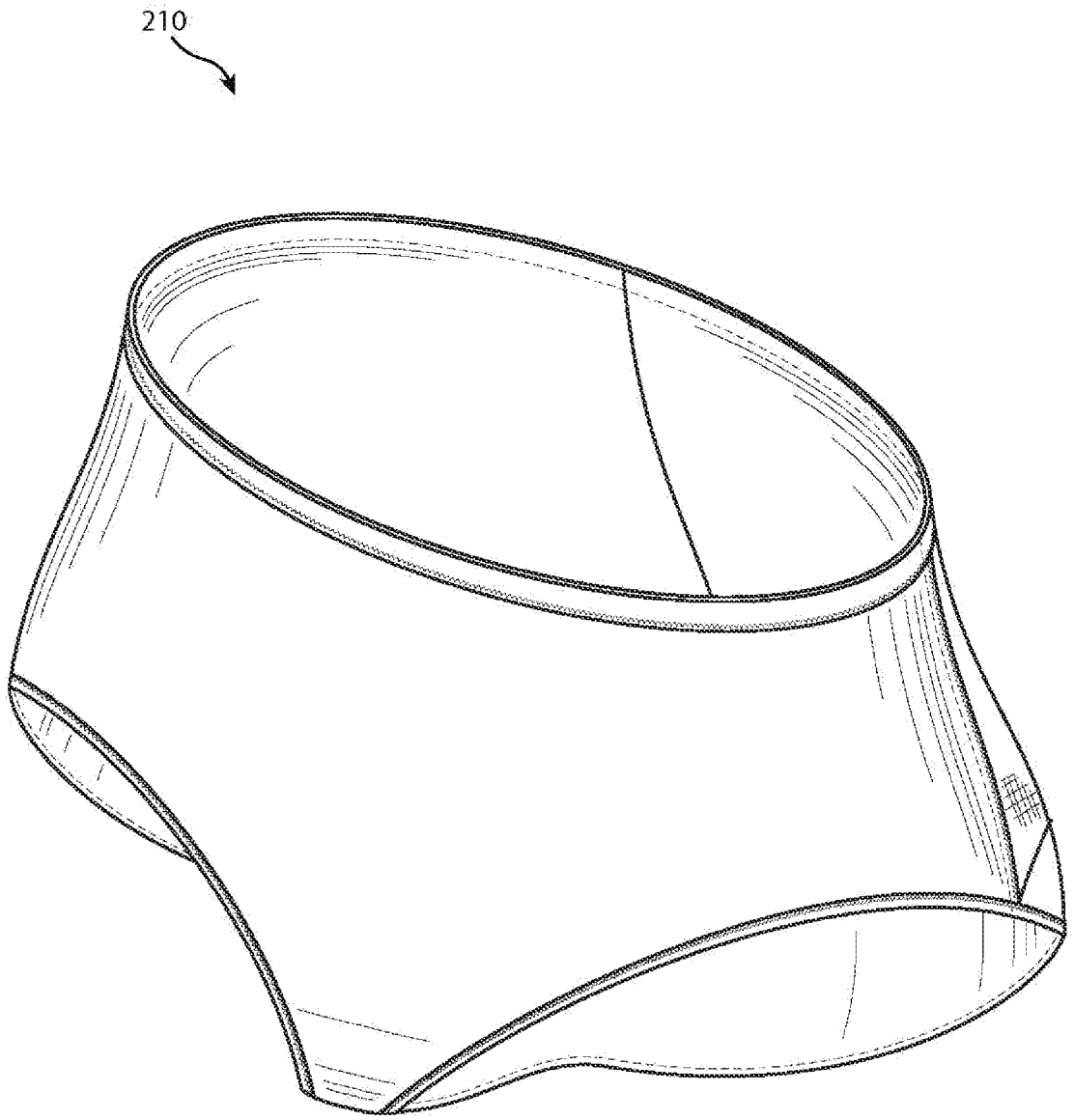
FIG. 24 is a front, perspective view illustration of the swimwear garment of FIG. 17 in an inside-out configuration, according to one embodiment of the present invention.
Figure 25:
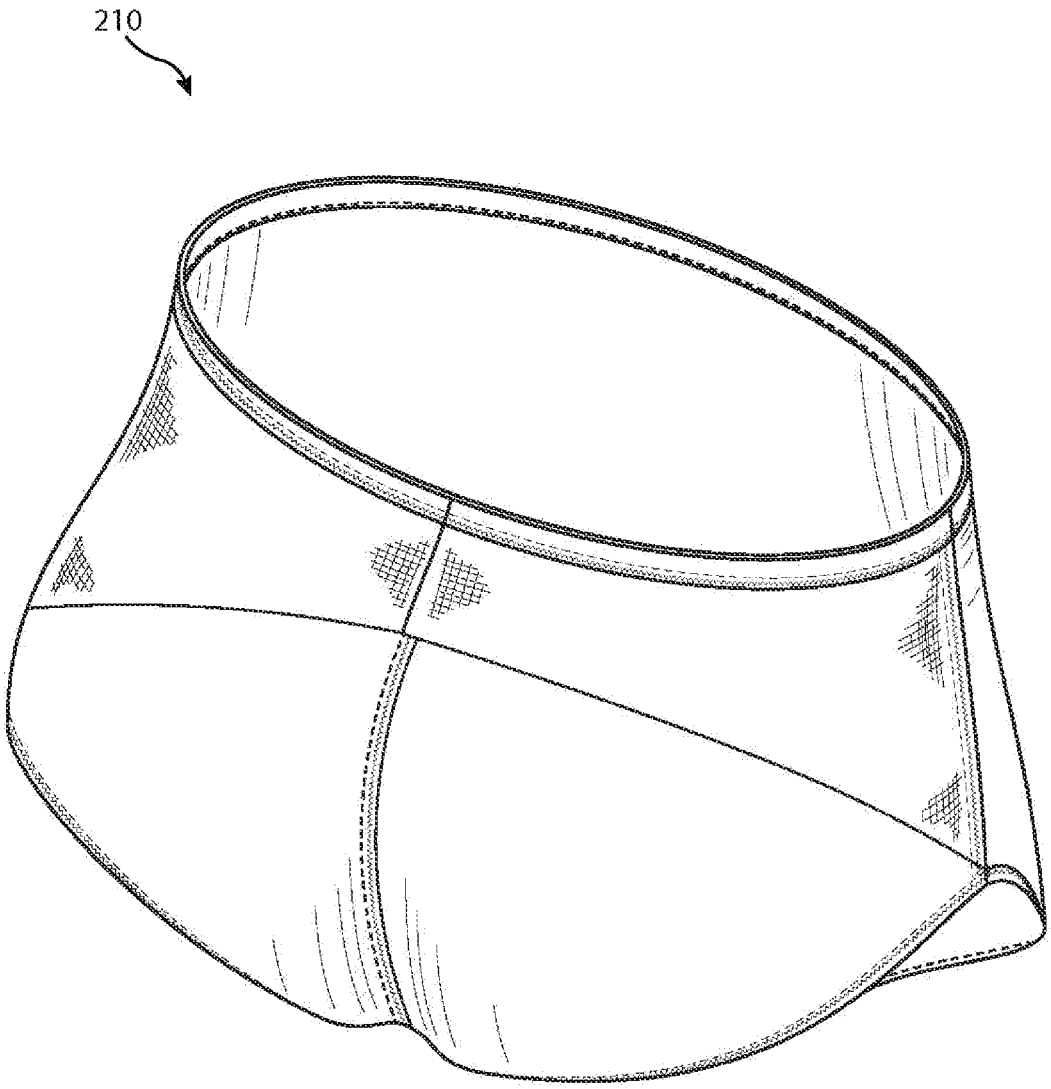
FIG. 25 is a rear, perspective view illustration of the swimwear garment of FIG. 24, according to one embodiment of the present invention.
Figure 26:
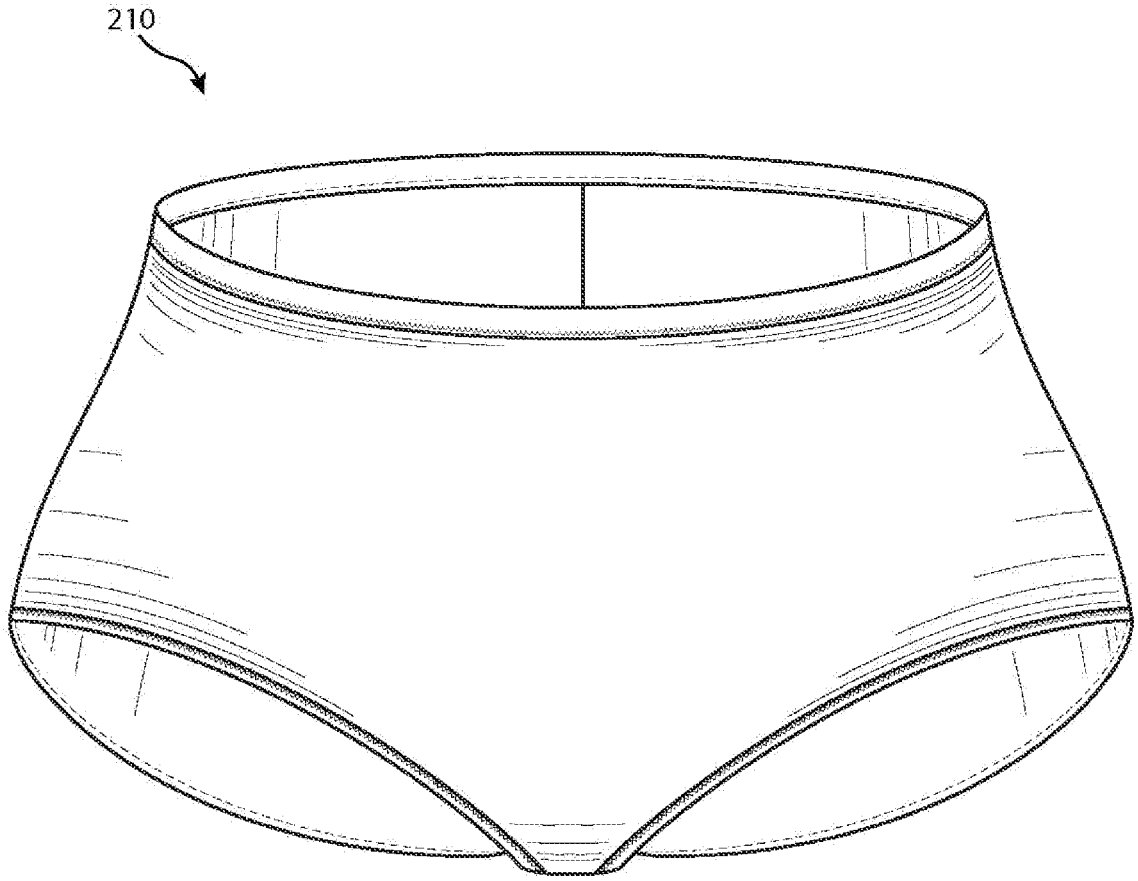
FIG. 26 is a front view illustration of the swimwear garment of FIG. 24, according to one embodiment of the present invention.
Figure 27:
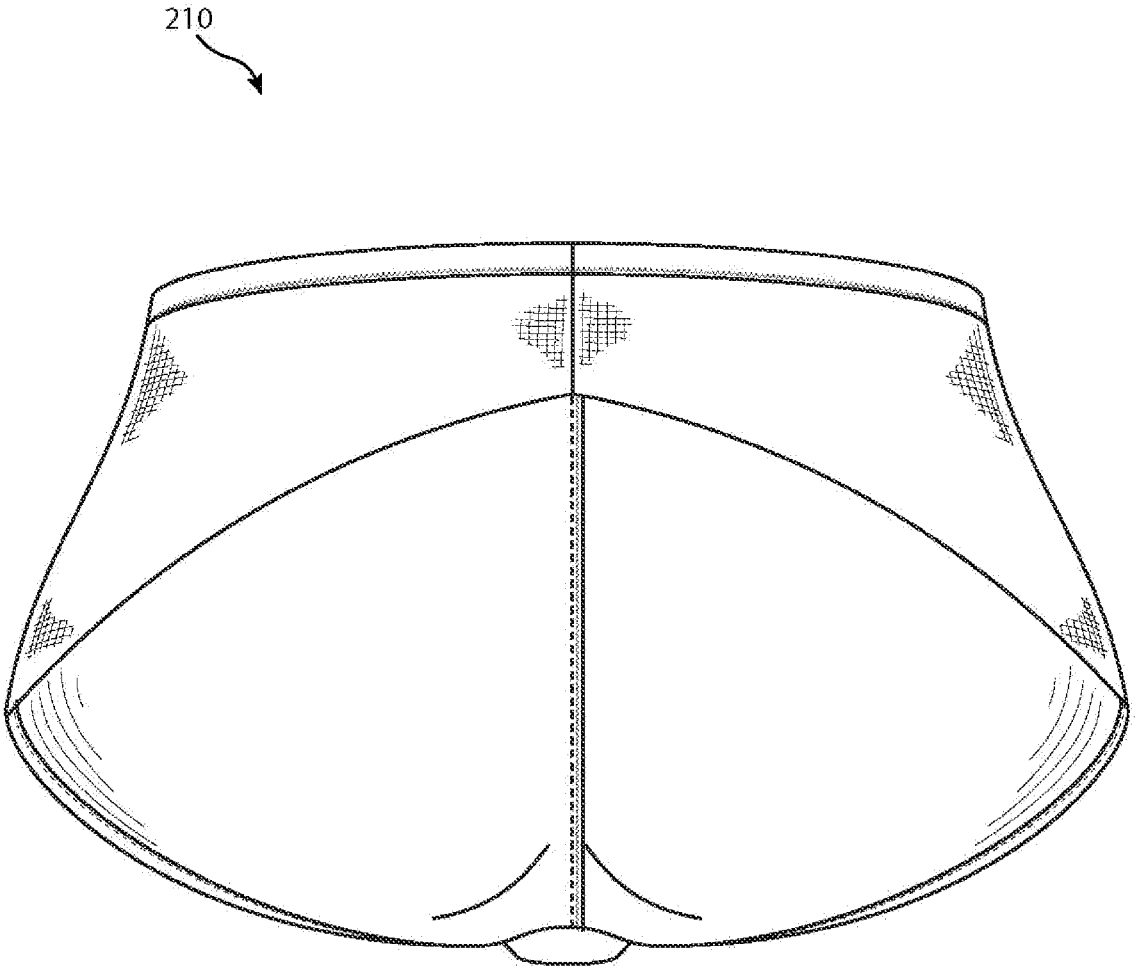
FIG. 27 is a rear view illustration of the swimwear garment of FIG. 24, according to one embodiment of the present invention.
Figure 28:
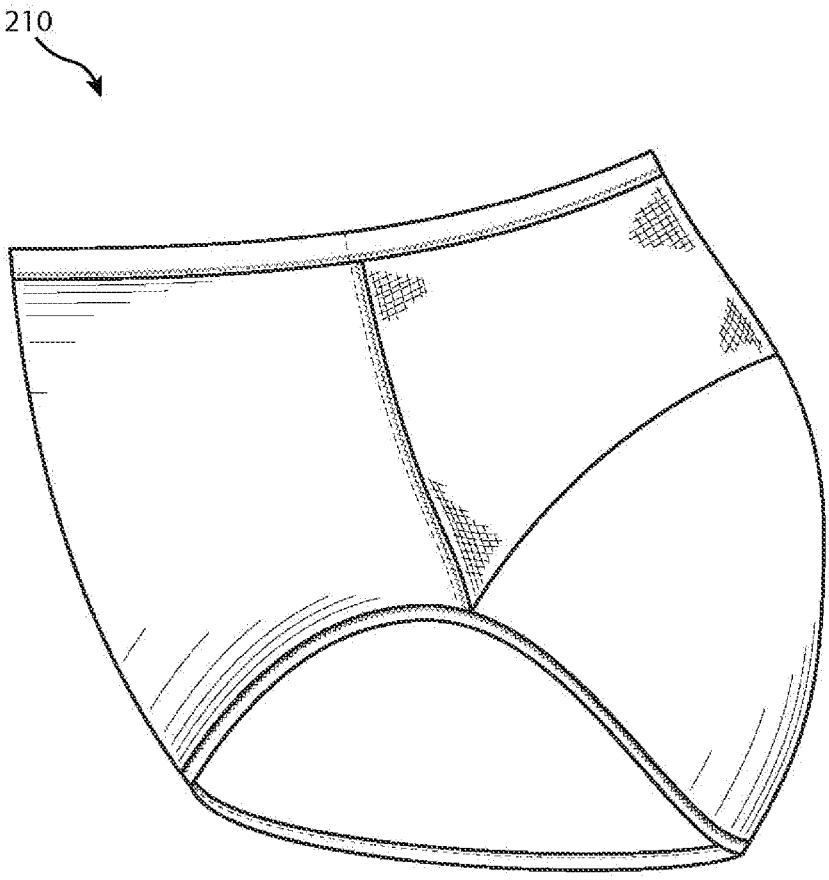
FIG. 28 is a right side view illustration of the swimwear garment of FIG. 24, according to one embodiment of the present invention, where the left side view is a mirror image of the right side view.
Figure 29:
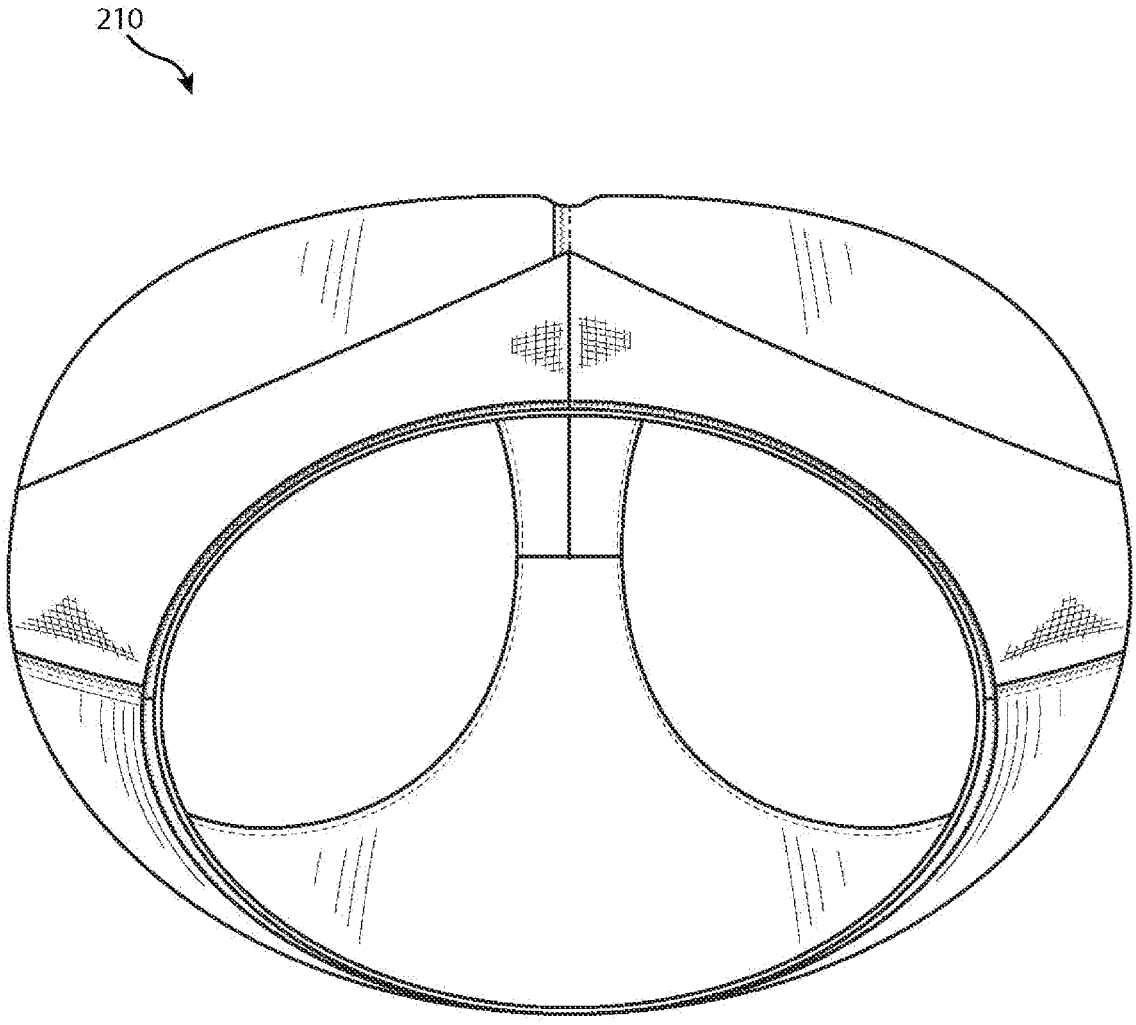
FIG. 29 is a top view illustration of the swimwear garment of FIG. 24, according to one embodiment of the present invention.
Figure 30:
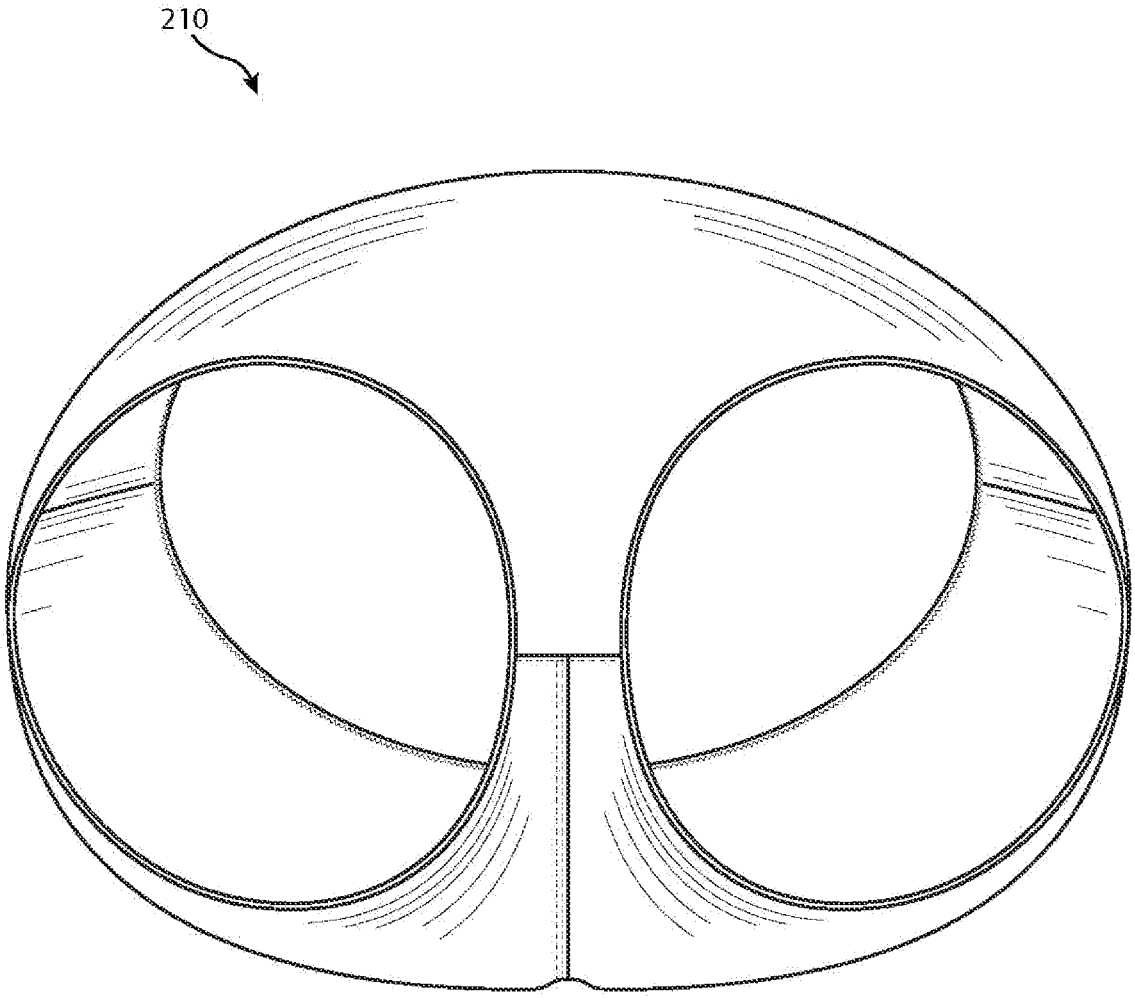
FIG. 30 is a bottom view illustration of the swimwear garment of FIG. 24, according to one embodiment of the present invention.

In one example, swimwear garment 10 more particularly includes an outer front layer 30, an outer rear layer 32, a front compression layer 34, and a rear compression layer 36 per one example of the innovation as best shown in the inside-out views of FIGS. 1 and 9-15 and with additional reference to the exploded view of FIG. 16. Outer front layer 30 is coupled to outer rear layers 32 to form the basic construct of swimwear garment 10 with the two collectively defining each of waistband 20, leg openings 22, and crotch 24. Front compression layer 34 generally lines an entirety of an inside surface 40 of outer front layer 30 providing additional compression to wearer 12 (FIG. 1). Rear compression layer 36 only partially lines an inside surface 42 of the outer rear layer 32 selectively providing additional compression to wearer 12.

In one embodiment, outer front layer 30 and outer rear layer 32 are both formed of the same or a substantially similar, flexible material appropriate for use in the water. For example, outer front layer 30 and outer rear layer 32 are each formed of a fabric with flexible, elastomeric, and water safe properties, such as a combination of spandex and nylon or polyester and spandex in a tricot-type knit, a raschel-type knit, a circular knit, or other suitable knit, spandex, or other spandex combinations. In one example, outer front layer 30 and outer rear layer 32 are formed of a material including a LYCRA® fabric (a registered trademark of DuPont Corporation), either alone or in combination with nylon, polyester, or other suitable fabric type, having four-way stretchability to best allow for swimwear garment to fit different shapes and sizes of wearers without substantial modification to the pattern or design of the garment. Other fabrics suitable for use in swimwear and will be apparent to those of skill in the art upon reading this present application.

As cut from the suitable fabric, outer front layer 30 defines an outside surface 50 opposite inside surface 40 each being collectively defined between an upper periphery 52, a bottom periphery 54, and side edges 56, where each of side edges 56 extends between ends of upper periphery 52 and bottom periphery 54 opposite one another, according to one embodiment. In one example, upper periphery 52 will partially define waistband 20, and bottom periphery 54 defines a central crotch edge 60 and two leg opening edges 62, each leg opening edge 62 extending from the lower portion of each of a different one of side edges 56 inwardly to opposite side of central crotch edge 60. A distance between the two side edges 56, that is a width of outer front layer 30, is configured depending on the size of swim garment 10, but generally to cover the front portion 26 of swimwear garment 10 includes stretching to extend around a portion of each of the sides of swimwear garment 10. A distance between upper periphery 52 and crotch edge 60, that is, a height of outer front layer 30, is dependent upon the coverage of wearer 12 desired, for example, the height of outer front layer 30 is larger for a higher-waisted swimwear garment 10, such as that shown in FIGS. 1-16, and is smaller for a lower-waisted swimwear garment 210, such as that shown in FIGS. 17-30.

Front compression layer 34 is formed of a material configured to contour and slim one or more areas of the body of wearer 12, for example, buttocks, stomachs, hips, and breasts of a wearer depending upon where and how used in garment. While both front compression layer 34 and outer front layer 30 provide some compression to wearer 12 due to their elastomeric nature, in one example, front compression layer 34 is formed of a more compressive fabric than outer front layer 30. More specifically, front compression layer 34 is formed of a fabric that has a heavier weight and a higher elastic modulus than the fabric forming outer front layer 30, such that it has a lower elasticity than the fabric forming outer front layer 30, and it serves to reduce waist girth and stomach protrusion when worn by wearer and placed to cover at least a portion of wearer's 12 stomach and/or waist providing desirable sculpting benefits to wearer 12. In one embodiment, front compression layer 34 is formed of a fabric including spandex, such as a spandex and nylon or spandex and polyester fabric in at least one of a tricot knit, raschel knit, simplex knit, power mesh, or other suitable fabric as will be known to those of skill in the art upon reading this application.

Front compression layer 34 is, in one embodiment, sized and shaped substantially identically to outer front layer 30 such that front compression layer 34 covers an entirety of inside surface 40 thereof. In this manner, front compression layer 34 defines an inside surface 70, an outside surface 72 opposite inside surface 70 each being collectively defined between an upper periphery 74, a bottom periphery 76, and side edges 78, where each of side edges 78 extends between ends of upper periphery 74 and bottom periphery 76 opposite one another, according to one embodiment. In one example, upper periphery 74 will partially extend along or near waistband 20, and bottom periphery 76 defines a central crotch edge 80 and two leg opening edges 82, each leg opening edge 82 extending from the lower portion of each of a different one of side edges 78 inwardly to opposite side of central crotch edge 80.

Outer front layer 30 is configured to fully cover outside surface 72 of front compression layer 34, such that front compression layer 34 generally is not visible by an observer externally viewing swimsuit 10 while it is worn by wearer 12, in a manner providing an aesthetically pleasing appearance. In one embodiment, outer front layer 30 is sewn to front compression layer 34 along each of upper peripheries 52 and 74, leg opening peripheries 54 and 76, side edges 56 and 78, and central crotch edges 60 and 80 either entire before assembly with outer rear layer 32 or partially before assembly with outer rear layer 32 with remaining portions being sewn together during assembly with outer rear layer 32. In this manner front portion 26 of swimwear garment 10 is formed continuously as a dual layer, front portion 26.

As cut from the suitable fabric, outer rear layer 32 defines an outside surface 90 opposite inside surface 42 each being collectively defined between an upper periphery 92, a bottom periphery 94, and side edges 96, where each of side edges 96 extends between ends of upper periphery 92 and bottom periphery 94 opposite one another, according to one embodiment. In one example, upper periphery 92 will partially define waistband 20, and bottom periphery 94 defines a central crotch edge 80 and two leg opening edges 82, each leg opening edge 82 extending from the lower portion of each of a different one of side edges 78 inwardly to opposite side of central crotch edge 80. A distance between the two side edges 78, that is a width of outer rear layer 32, is configured depending on the size of swim garment 10, but generally to cover the rear portion 28 of swimwear garment 10 and stretching to extend around a portion of each of the sides of swimwear garment 10. A distance between upper periphery 92 and crotch edge 100, that is, a height of outer rear layer 32, is dependent upon the coverage of wearer 12 desired, for example, the height of outer rear layer 32 is larger for a higher-waisted swimwear garment 10, such as that shown in FIGS. 1-16, and is smaller for a lower-waisted swimwear garment 210, such as that shown in FIGS. 17-30.

In one embodiment, as best shown in FIG. 16, outer rear layer 32 is formed by two substantially symmetrical pieces 32A and 32B having central edges 104 that are sewn together along a back seam 106 to join the two outer rear layer pieces 32A and 32B to each other. In this manner, the two outer rear layer pieces 32A and 32B each form a different portion 90A or 90B of upper periphery 90 and a different portion 92A or 92B of bottom periphery 92. In one example, each of the two outer rear layer pieces 32A and 32B form a different one of side edges 96, one of leg opening edges 102, and a different portion 100A or 100B of central crotch edge 100.

In one embodiment, rear compression layer 36 is formed of a self-start mesh or power mesh, which is very thin in nature and can use the natural edge of the fabric created during knitting without generally requiring a hem, binding, or other finishing that may contribute to bulging of swimwear garment 10 to prevent unraveling, etc. In one embodiment, self-start mesh has a lower elasticity than the fabric forming outer front layer 30 and outer rear layer 32, but higher elasticity than the fabric forming front compression layer 34. In this manner, rear compression layer 36 provides a lower level of sculpting and control than front compression layer 34. In one embodiment, rear compression layer 36 is formed of a fabric including spandex, such as a spandex and nylon or spandex and polyester fabric in at least one of a tricot knit, raschel knit, simplex knit, power mesh, or other suitable fabric as will be known to those of skill in the art upon reading the present application.

Rear compression layer 36 is, in one embodiment, sized and shaped to cover only a top portion of inside surface 42 of outer rear layer 32. In one example, rear compression layer 36 defines an inside surface 110, an outside surface 112 opposite inside surface 110 each being collectively defined between an upper periphery 114, a bottom periphery 116, and side edges 118. Each of side edges 118 extends between ends of upper periphery 114 and bottom periphery 116 opposite one another, according to one embodiment. In one example, upper periphery 114 will partially extend along or near waistband 20, and bottom periphery 116 defines a raw edge in a generally inverted V-shape or similar shape. More specifically, bottom periphery 116 extends from a bottom point 122 along each of side edges 118 that is further away from upper periphery 114 than a middle or apex point 120, about halfway between side edges 118.

In one example, where a first distance $D_1$ is measured between bottom point 122 and upper periphery 116 and a second distance $D_2$ is measured between apex point 120 and upper periphery 116, second distance $D_2$ is between about 30 percent and about 65 percent of first distance $D_1$, for example, between about 40 percent and about 60 percent of first distance $D_1$ as measured when rear compression layer 36 is laid substantially flat and not on wearer 12. Otherwise stated, in one embodiment, second distance $D_2$ is between about one-third and about two-thirds of first distance $D_1$. In one example, the percent distance $D_2$ extends relative to $D_1$ is higher int the provided range for high-waisted swimwear garment bottoms than for natural or low-waisted swimwear garment bottoms.

Figure 10:
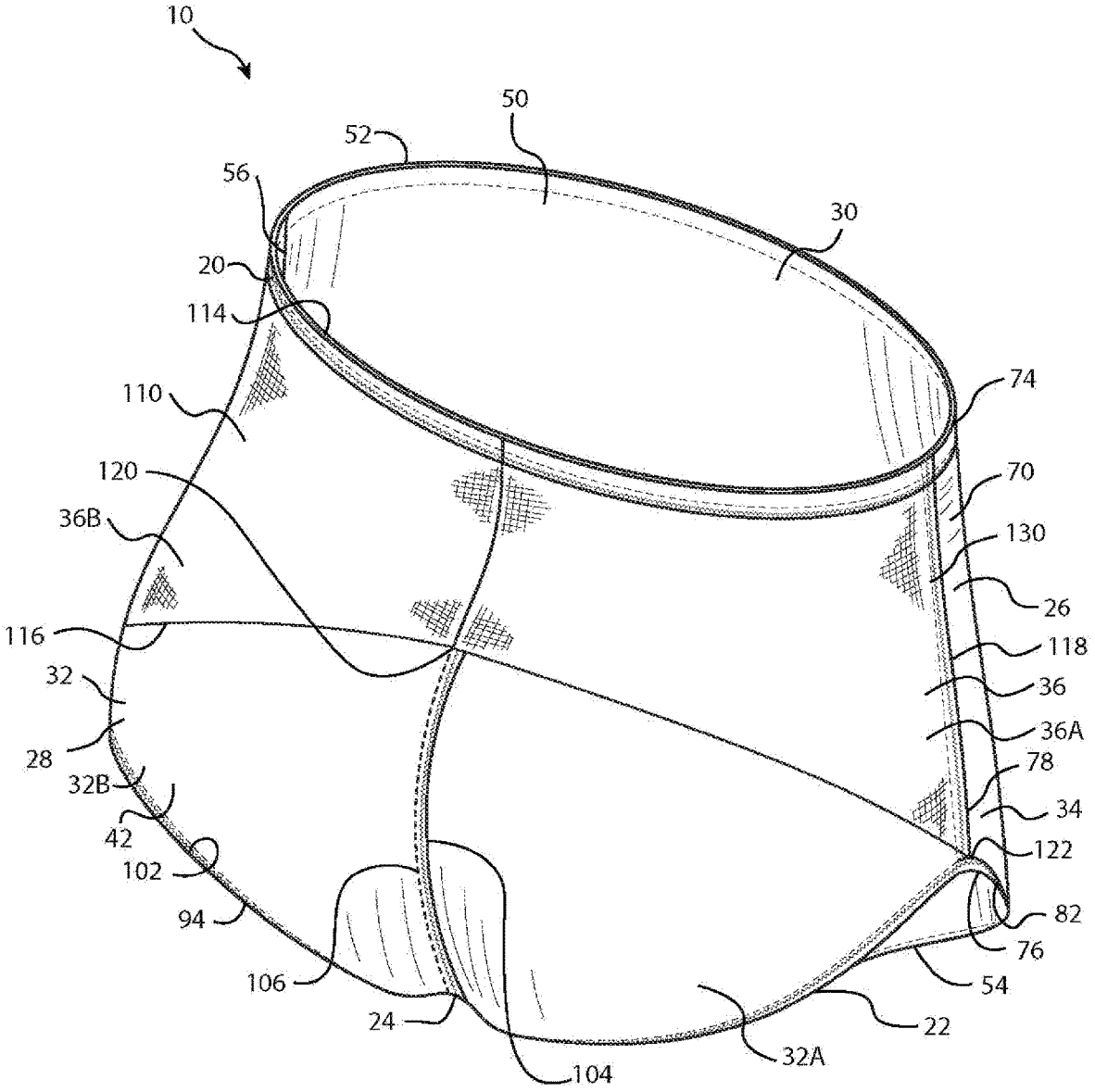
FIG. 10 is a rear, perspective view illustration of the swimwear garment of FIG. 9, according to one embodiment of the present invention.
Figure 11:
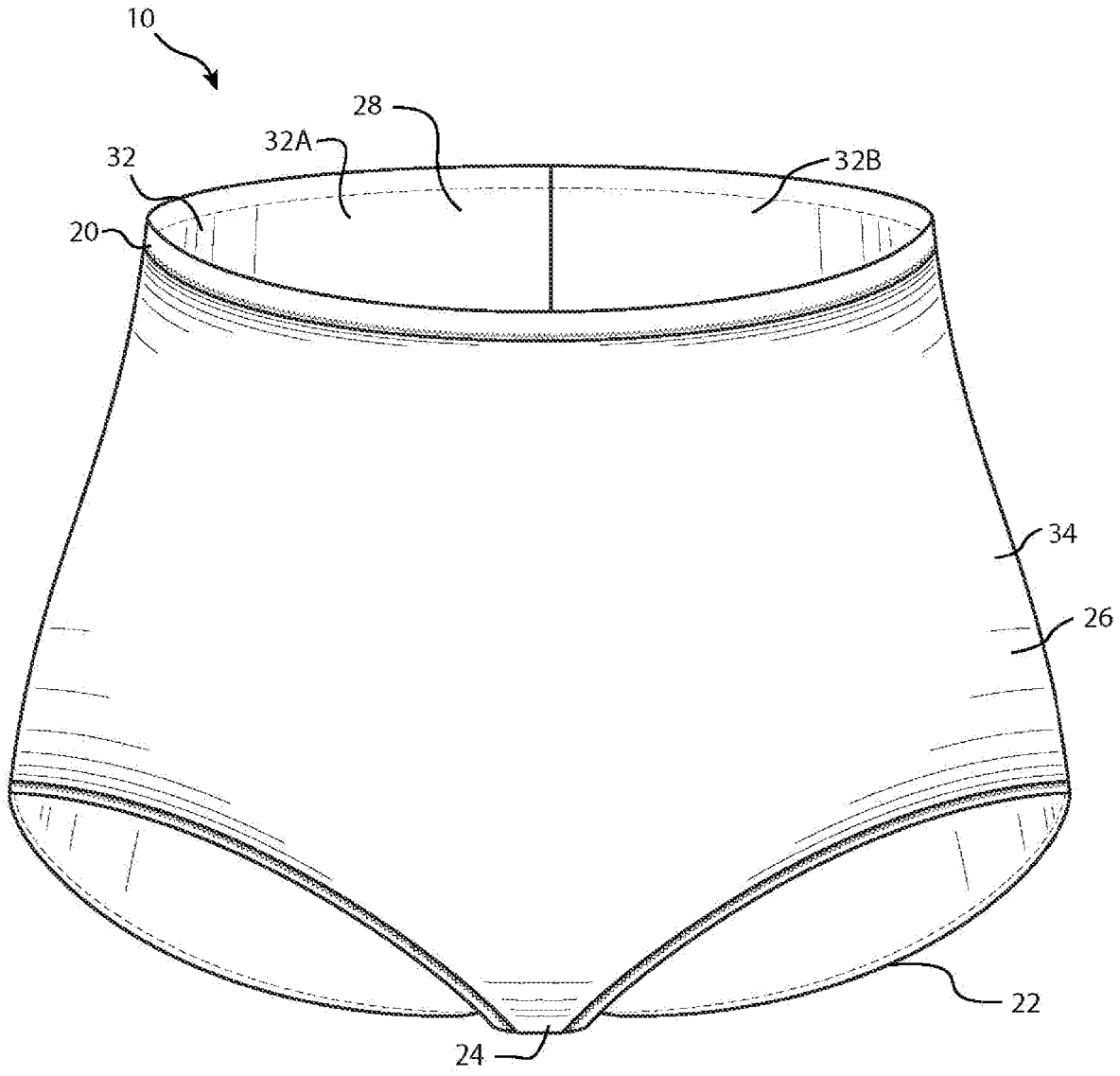
FIG. 11 is a front view illustration of the swimwear garment of FIG. 9, according to one embodiment of the present invention.
Figure 12:
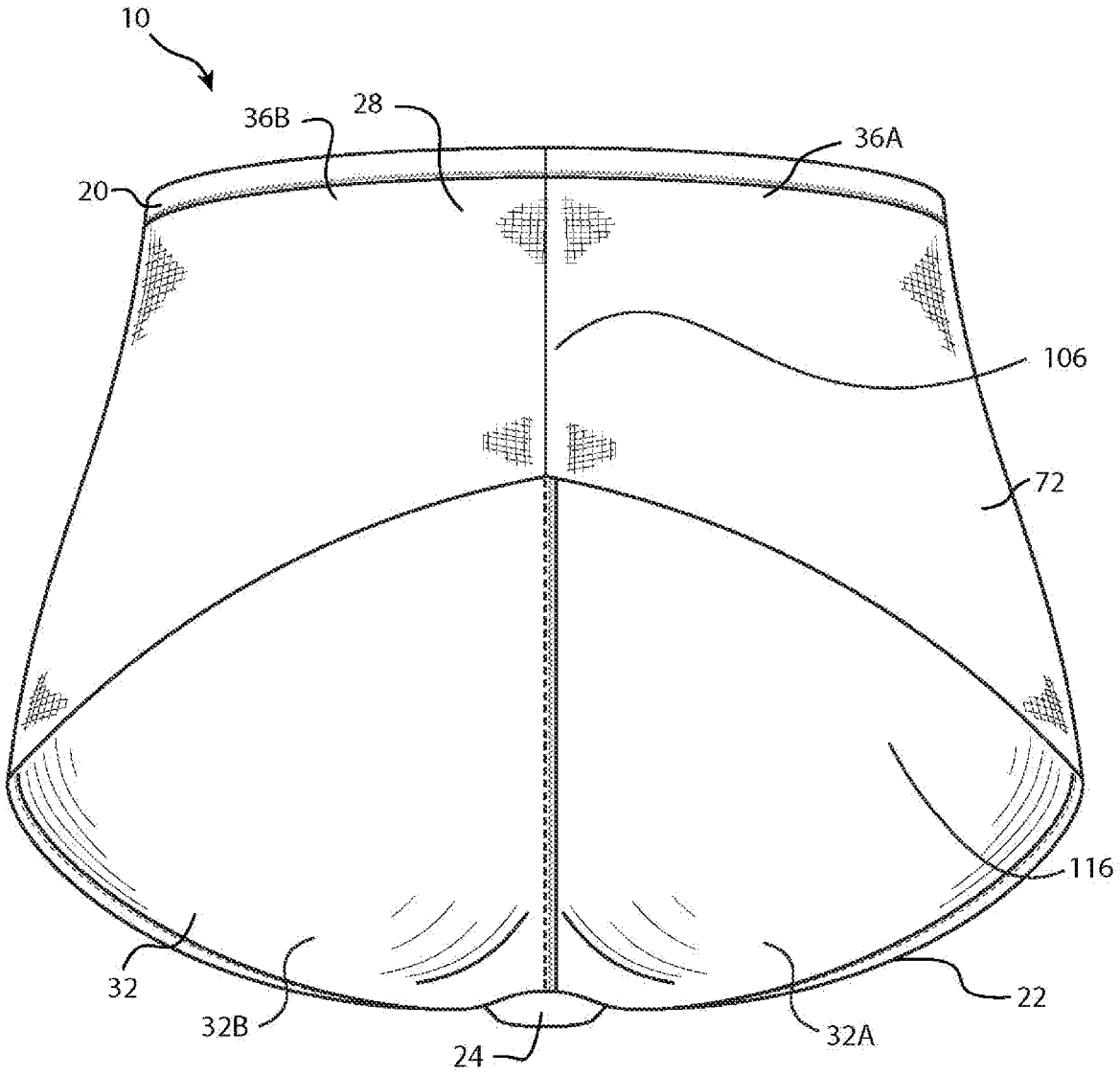
FIG. 12 is a rear view illustration of the swimwear garment of FIG. 9, according to one embodiment of the present invention.
Figure 13:
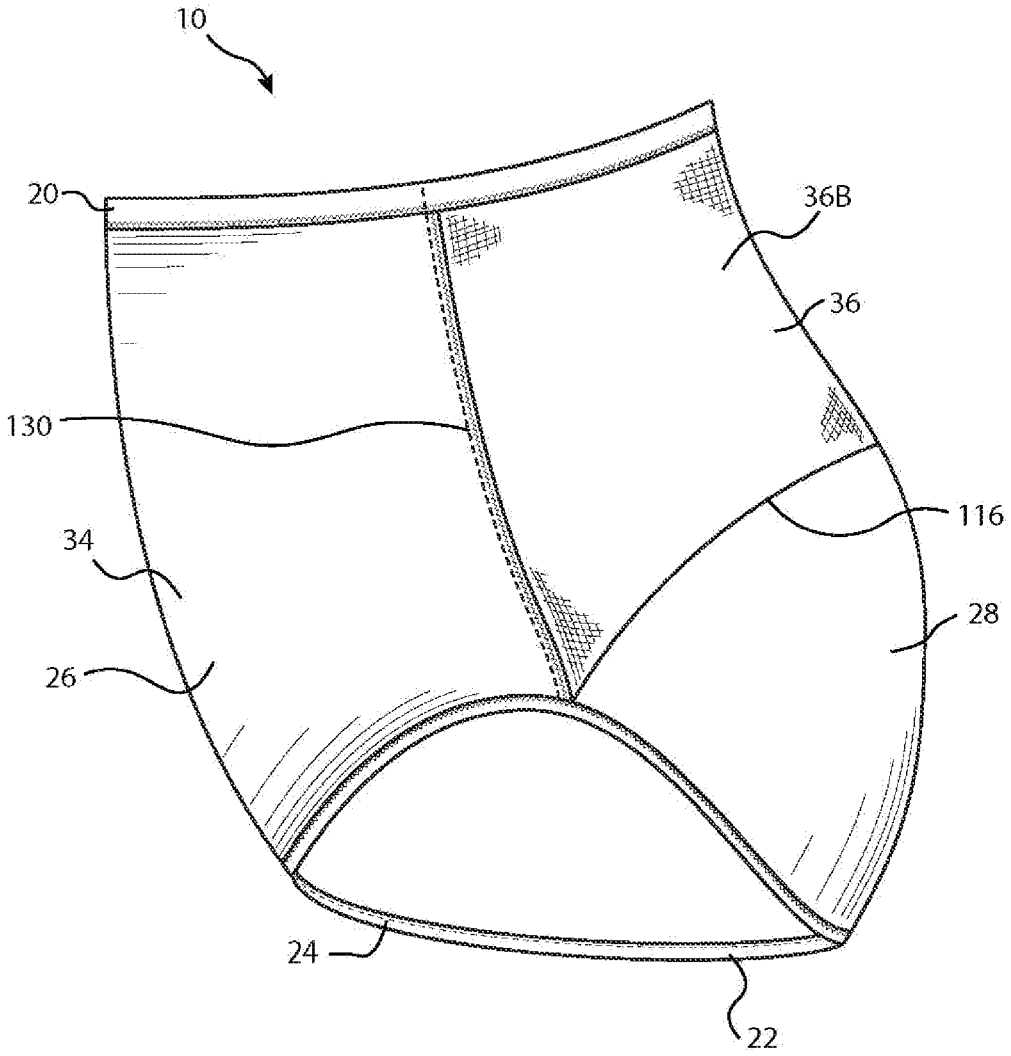
FIG. 13 is a right side view illustration of the swimwear garment of FIG. 9, according to one embodiment of the present invention, where the left side view is a mirror image of the right side view.
Figure 14:
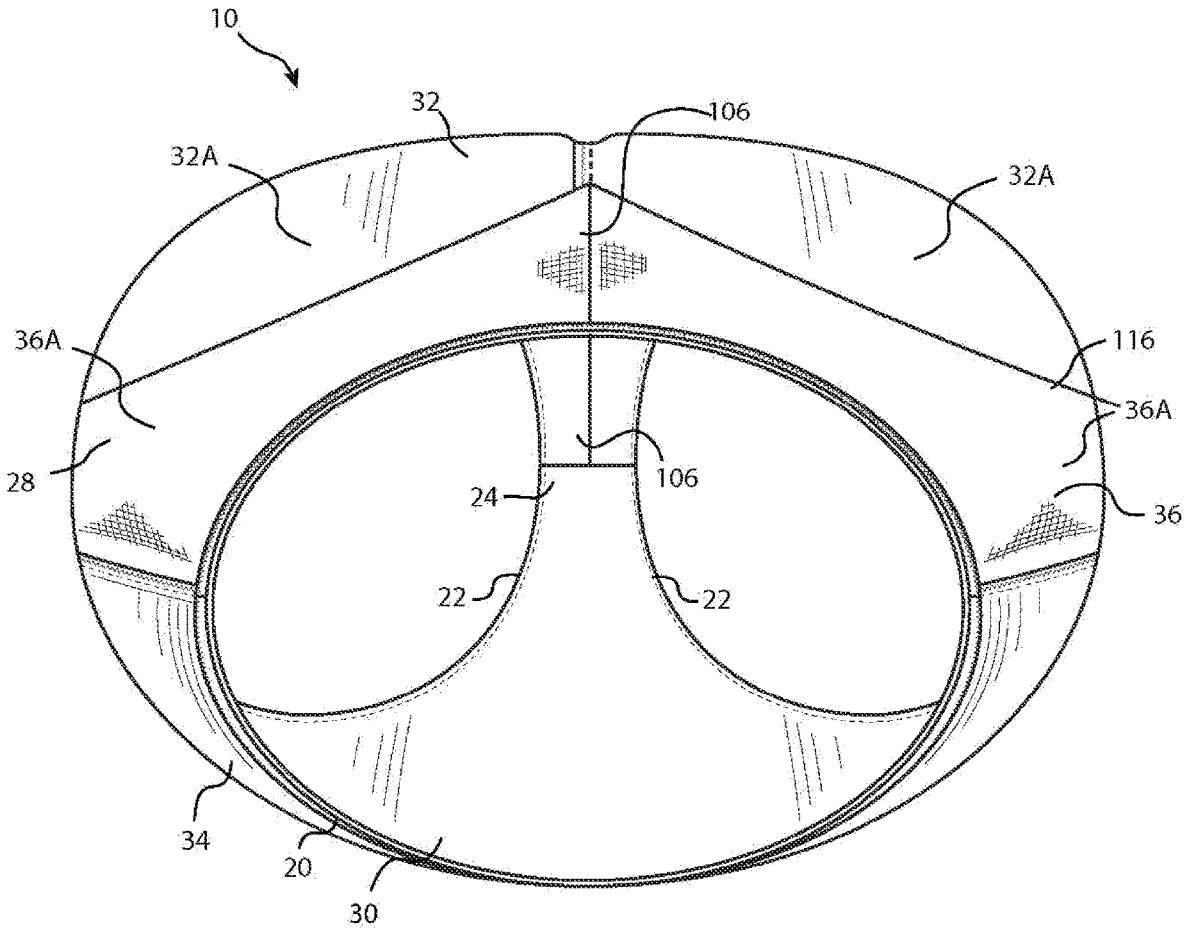
FIG. 14 is a top view illustration of the swimwear garment of FIG. 9, according to one embodiment of the present invention.
Figure 15:
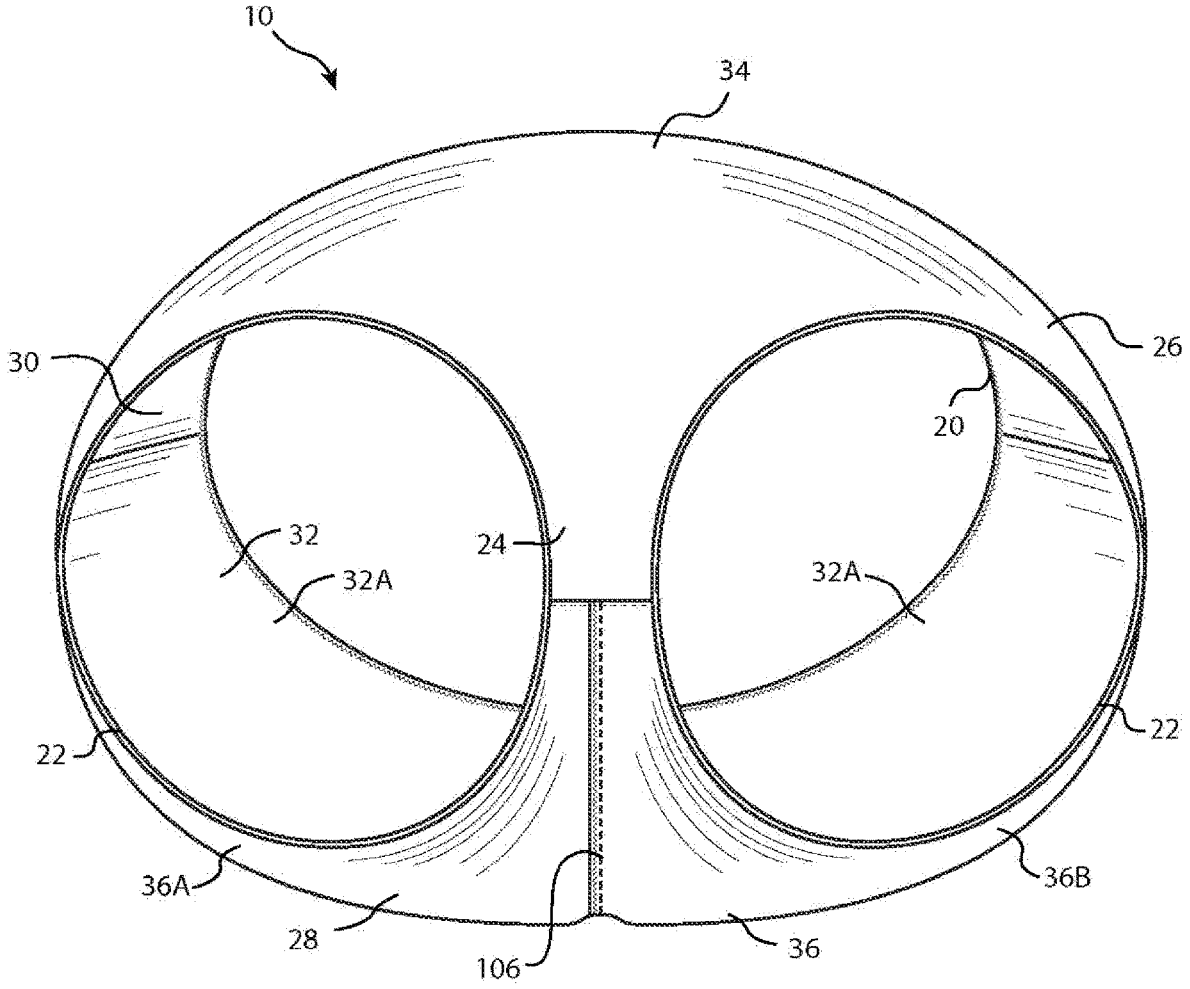
FIG. 15 is a bottom view illustration of the swimwear garment of FIG. 9, according to one embodiment of the present invention.

In one embodiment, as best shown in FIG. 16 with additional reference to FIGS. 10, 12, and 13, rear compression layer 36 is formed by two substantially symmetrical rear compression layer pieces 36A and 36B having central edges 104 opposite the corresponding one of side edges 118. Central edges 104 are sewn together along a rear compression layer back seam 124 or along back seam 106 together with outer rear layer pieces 32A and 32B to join the two rear compression layer pieces 32A and 32B to each other and/or to outer rear layer pieces 32A and 32B. In this manner, the two rear compression layer pieces 36A and 36B each form a different portion 114A or 114B of upper periphery 114 and a different portion 116A or 116B of bottom periphery 92. In one example, each of the two rear compression layer pieces 36A and 36B form a different one of side edges 118 and a different one 122A and 122B of bottom points 122. In one example, rear compression layer back seam 124 or a portion of rear compression layer 36 near back seam 124 is at least tacked or otherwise spot coupled to back seam 106, if it is not sewn into seam 106, to prevent undesired shifting of rear compression layer 36 relative to outer rear layer 32 during wear.

In one embodiment, outer rear layer 32 is configured to fully cover outside surface 112 of rear compression layer 36, such that rear compression layer 36 generally is not visible by an observer externally viewing swimsuit 10 while it is worn by wearer 12, in a manner providing an aesthetically pleasing appearance. In one embodiment, outer rear layer 32 is sewn to rear compression layer 36 along each of upper peripheries 92 and 114, and side edges 96 and 118 either entire before assembly with outer front layer 30 or partially before assembly with outer front layer 30 with remaining portions being sewn together during assembly with outer front layer 30. In this manner, rear portion 28 of swimwear garment 10 is formed partially of dual layer construction and partially of single layer construction.

Dual layer front portion 26 is sewn along two opposing side seams 130 to partially dual layer rear portion 28 in a manner sewing each pair of aligned side edges 56, 78 of outer front layer 30 and front compression layer 34 to a different one of aligned side edges 96, 118 of outer rear layer 32 and rear compression layer 36 such that inside surfaces 40, 70 of outer front layer 30 and front compression layer 34 face inside surfaces 42, 110 of outer rear layer 32 and rear compression layer 114. In one example, front portion 26 is sewn to rear portion 28 such that upper peripheries 52, 74 generally align with upper peripheries 92, 114 along side seams 130 and/or leg opening edges 62, 82 generally align with leg opening edges 102 align side seams 130. While front compression layer 34 and rear compression layer 36 are generally described above as being coupled to a remainder of the swimwear garment via sewing or stitches, any method known in in that for permanently attaching front compression layer 34 and rear compression layer 36 to a remainder of the swimwear garment are also contemplated, such as fabric bonding, waterproof adhesive, etc.

When swimwear garment 10 is constructed, in one embodiment, each of bottom points 122 of rear compression layer 36 is positioned at or near the intersection of a different one of leg opening edges 102 and a corresponding side seam 130. In this manner, bottom points 122 of rear compression layer 36 will generally align with bottom periphery 76 of front compression layer 34 at side seams 130. The alignment between front compression layer 34 and rear compression layer 36 at side seams 130 provides additional stability to front compression layer 36 within swimwear garment 10, as compared to front compression layer 36 being coupled solely to the more elastic outer rear layer 32 (not shown). In this manner, and due to the securement of front compression layer 34 at each of side seams 130 and interaction with rear compression layer 36, front compression layer 34 is sufficiently secured to be pulled taught against the lower stomach of wearer 12 to decrease protrusion of the stomach of wear 12 at portions covered by front portion 26 of swimwear garment 10.

The rear compression layer 36, while being generally less compressive than front compression layer 24 helps maintain the pull on or tautness of front compression layer 36 and provides some control around a back of the waist of wearer 12. However, due to the generally inverted V-shape of the bottom periphery 116 of rear compression layer 36, the buttocks of wearer 12 are generally maintained below the bottom periphery 116 to be covered only by the outer rear layer 32 of swimwear garment 10. In this manner, increased control or constriction of swimwear 10 is not significantly imparted on the buttocks, allowing the buttocks to appear more natural and full body without being cinched in by either front compression layer 35 or rear compression layer 36. Still further, due to the thin nature of the rear compression layer 36, the location of the bottom periphery 116 of the rear compression layer 36 is not readily noticeable or seen from an outside of swimwear garment 10 through outer rear layer 32, so as not to impact the exterior aesthetics of swimwear garment 10.

Once front portion 26 and rear portion 28 are coupled together, an elastic band 132 is secured to the upper peripheries 52, 74, 92, 114 thereof, for example, by folding front portion 26 and rear portion 28 to collectively form a circular tunnel (not shown) for enclosing and receiving elastic band 132, and/or lower elastic bands 134 are secured around each of the leg openings 22, for example, buy folding the portions of front portion 26 and rear portion 28 the collectively define leg openings 22 to form circular tunnels for enclosing and receiving elastic bands 134. Other manners of coupling elastic bands 132 and 134 to swimwear garment 10 or for defining waistband 20 and leg openings 22 without elastic bands are also contemplated and will be apparent to those of skill in the art upon reading the present application.

Figure 31:
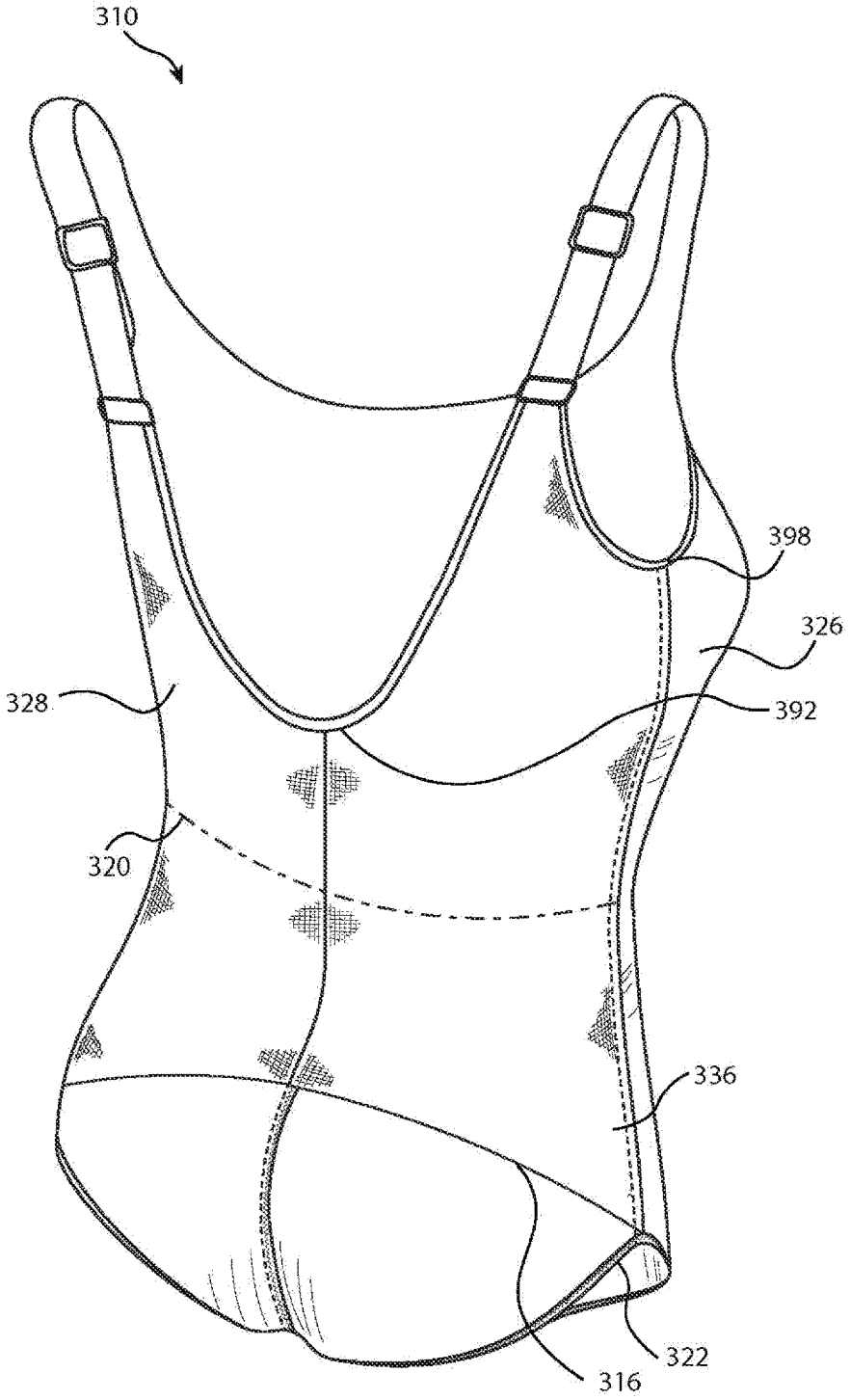
FIG. 31 is a rear view illustration of a swimwear garment in an inside-out configuration, according to one embodiment of the present invention.

Other embodiments of swimwear garments with the selective control of swimwear garments 10 and 210 are also contemplated. For example, FIG. 31 shows swimwear garment in the form of a one-piece swimwear garment 310 such that it extends beyond a waist 320 to cover a large part of the torso of the wearer including the wearer's breasts, as will be apparent to those of skill in the art. Swimwear garment 310 may include a partial or entirely dual-layer front portion 326 and an only partially dual-layer rear portion 328 in similar manners as described above for front portion 26 and rear portion 28, see FIGS. 1-16) above except for at least those differentiations enumerated below. In one embodiment, a rear compression layer 336 of swimwear garment 310 includes a bottom periphery 316 like rear compression layer 36 and positioned similarly in swimwear garment 310 as described with respect to swimwear garment 10 relative to leg openings 322 and a waist 320 of wearer 12 as opposed to a waistband of wearer 12. Rear compression layer 336 may extend to the waist 320 or to another termination point above waist 320, for example, at and sewn into the top rear edge 392 of swimwear garment 310 and along arm openings 398 of swimwear garment 310 or at a sew line or termination point between waist 320 and top rear edge 392. In this manner, swimwear garment 310 provides similar advantages as swimwear garment 10, such as increased compression of the wearer's stomach and waist and little compression of the wearer's buttocks.

Although the invention has been described with respect to particular embodiments, such embodiments are meant for illustrative purposes only and should not be considered to limit the invention. Various alternatives and changes will be apparent to those of ordinary skill in the art upon reading this application. Other modifications within the scope of the invention and its various embodiments will also be apparent to those of ordinary skill in the art upon reading this application.

What is claimed is:

1. A swimwear garment configured to be worn by a wearer having buttocks, the swimwear garment comprising:

an outer rear layer defining at least rear portions of two leg openings and extending upwardly from the two leg openings toward a waist of the swimwear garment in a manner configured to at least partially cover the buttocks of the wearer;

a rear compression layer coupled to the outer rear layer along an inside surface of the outer rear layer, the rear compression layer defining a bottom periphery and opposing side edges, the rear compression layer extending upwardly from the bottom periphery toward the waist of the swimwear garment;

wherein:

each of the opposing side edges of the rear compression layer are sewn to corresponding side edges of the outer rear layer creating two opposing side seams, the bottom periphery of the rear compression layer extends inwardly from each of the two leg openings tapering upwardly toward the waist to an apex of the bottom periphery, and the bottom periphery of the rear compression layer is free from direct securement to the outer rear layer as the bottom periphery of the rear compression layer extends from each of the two leg openings to the apex.

2. The swimwear garment of claim 1, wherein the bottom periphery of the rear compression layer is a natural fabric edge free from hemming and binding.

3. The swimwear garment of claim 1, wherein the apex of the rear compression layer is positioned a first distance from the waist that is at least 30% smaller than a second distance substantially vertically measured from the waist to a top of either one of the two leg openings.

4. The swimwear garment of claim 1, wherein the apex of the rear compression layer is positioned a first distance from the waist that is in the range of about 30% to 60% smaller than a second distance substantially vertically measured from the waist to a top of either one of the two leg openings.

5. The swimwear garment of claim 1, further comprising a waistband around the waist of the swimwear garment, and both the outer rear layer and the rear compression layer extend to and are sewn into the waistband.

6. The swimwear garment of claim 5, wherein the waistband includes an elastic band at least partially enclosed by a portion of the outer rear layer of the swimwear garment.

7. The swimwear garment of claim 1, wherein the rear compression layer is secured to the outer rear layer at the apex of the bottom periphery of the rear compression layer.

8. The swimwear garment of claim 1, wherein the rear compression layer is secured to the outer rear layer along a line extending substantially vertically upwardly from the apex of the bottom periphery to the waist.

9. The swimwear garment of claim 1, wherein the inside surface of the outer rear layer is uncovered below the bottom periphery of the rear compression layer in a manner configured to allow the inside surface of the outer rear layer below the bottom periphery of the rear compression layer to sit directly adjacent to the wearer during wear.

10. The swimwear garment of claim 1, wherein the rear compression layer defines a top periphery opposite the bottom periphery, the rear compression layer is only secured to the outer rear layer along the opposing side edges, the top periphery, and along a substantially vertical line extending from the apex toward the waist such that a remainder of the rear compression layer including the bottom periphery freely floats along the inside surface of the outer rear layer between where the rear compression layer is secured to the outer rear layer.

11. The swimwear garment of claim 1, wherein:

the rear compression layer defines a top periphery opposite the bottom periphery, and the rear compression layer is only secured to the outer rear layer along the opposing side edges and the top periphery such that a remainder of the rear compression layer including the bottom periphery freely floats on along the inside surface of the outer rear layer between its where the rear compression layer is secured to the outer rear layer.

12. The swimwear garment of claim 1, wherein:

the outer rear layer is formed of two substantially symmetrical outer rear layer pieces joined together along interior edges of each of the outer rear layer pieces via a back seam; and the rear compression layer is secured to the outer rear layer via the back seam.

13. The swimwear garment of claim 1, wherein:

the outer rear layer is formed of two substantially symmetrical outer rear layer pieces joined together along interior edges of each of the outer rear layer pieces via a back seam; and the rear compression layer is formed of two substantially symmetrical rear compression layer pieces joined together along interior edges of each of the rear compression layer pieces via the back seam.

14. The swimwear garment of claim 1, wherein:

the swimwear garment further comprises:

an outer front layer coupled to each of the side edges of the outer rear layer along each of the two opposing side seams such that during use the wearer is positioned between the outer rear layer and the outer front layer.

15. The swimwear garment of claim 14, wherein the rear compression layer is secured to each of the outer rear layer and the outer front layer along each of the two opposing side seams.

16. The swimwear garment of claim 14, further comprising:

a front compression layer coextensively extending along an inside surface of the outer front layer between the two opposing side seams, the front compression layer having a higher modulus of elasticity than the rear compression layer, wherein the rear compression layer has a higher modulus of elasticity than both of the outer front layer and the outer rear layer.

17. The swimwear garment of claim 16, wherein the front compression layer is coupled to each of the opposite side edges of the rear compression layer via the opposing side seams.

18. The swimwear garment of the claim 14, wherein at least the outer front layer extends above the waist of the swimwear garment to cover breasts of the wearer.

19. A swimwear garment configured to be worn by a wearer having buttocks, the swimwear garment comprising:

an outer rear layer defining at least rear portions of two leg openings and extending upwardly from the two leg openings toward a waist of the swimwear garment in a manner configured to at least partially cover the buttocks of the wearer;

a rear compression layer coupled to the outer rear layer along an inside surface of the outer rear layer, the rear compression layer defining a bottom periphery and opposing side edges, the rear compression layer extending upwardly from the bottom periphery toward the waist of the swimwear garment;

wherein:

each of the opposing side edges of the rear compression layer are sewn to corresponding side edges of the outer rear layer, the bottom periphery of the rear compression layer extends inwardly from each of the two leg openings tapering upwardly toward the waist to an apex of the bottom periphery, the bottom periphery of the rear compression layer is free from direct securement to the outer rear layer as the bottom periphery of the rear compression layer extends from each of the two leg openings to the apex, and the opposing side edges of the rear compression layer are each coupled to and continuously extensive to the corresponding side edges of the outer front layer as the opposing side edges of the rear compression layer extend from a top of the corresponding one of the two leg openings to the waist of the swim garment.

* * * * *